US010645515B2

(12) United States Patent
Beack et al.

(10) Patent No.: US 10,645,515 B2
(45) **Date of Patent: *May 5, 2020**

(54) MULTICHANNEL AUDIO SIGNAL PROCESSING METHOD AND DEVICE

(71) Applicant: Electronics And Telecommunications Research Institute, Daejeon (KR)

(72) Inventors: Seung Kwon Beack, Daejeon (KR); Jeong Il Seo, Daejeon (KR); Jong Mo Sung, Daejeon (KR); Tae Jin Lee, Daejeon (KR); Dae Young Jang, Daejeon (KR); Jin Woong Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/357,180

(22) Filed: Mar. 18, 2019

(65) Prior Publication Data

US 2019/0289413 A1 Sep. 19, 2019

Related U.S. Application Data

(63) Continuation of application No. 15/870,700, filed on Jan. 12, 2018, now Pat. No. 10,264,381, which is a (Continued)

(30) Foreign Application Priority Data

Jul. 1, 2014 (KR) ..... 10-2014-0082030
Jul. 1, 2015 (KR) ..... 10-2015-0094195

(51) Int. Cl.
*G10L 19/20* (2013.01)
*H04S 3/00* (2006.01)
(Continued)

(52) U.S. Cl.
CPC ..... *H04S 3/008* (2013.01); *G10L 19/008* (2013.01); *G10L 19/20* (2013.01);
(Continued)

(58) Field of Classification Search
CPC .. H04S 3/008; H04S 2400/03; H04S 2400/07; G10L 19/008; G10L 19/20
(Continued)

(56) References Cited

U.S. PATENT DOCUMENTS 7,788,107 B2 8/2010 Oh et al.
7,805,313 B2 9/2010 Faller et al.
(Continued)

FOREIGN PATENT DOCUMENTS

KR 10-2012-0099191 A 9/2012
WO WO 2007/078254 A2 7/2007
(Continued)

OTHER PUBLICATIONS

Quackenbush, S. et al., "MPEG surround," IEEE Multimedia, vol. 12.4, 2005 (pp. 18-23).
(Continued)

*Primary Examiner* — Melur Ramakrishnaiah
(74) *Attorney, Agent, or Firm* — NSIP Law

(57) ABSTRACT

Disclosed are a multi-channel audio signal processing method and a multi-channel audio signal processing apparatus. The multi-channel audio signal processing method may generate N channel output signals from N/2 channel downmix signals based on an N-N/2-N structure.

18 Claims, 30 Drawing Sheets

Related U.S. Application Data continuation of application No. 15/323,028, filed as application No. PCT/KR2015/006788 on Jul. 1, 2015, now Pat. No. 9,883,308.

(51) Int. Cl.
*G10L 19/008* (2013.01)
*G10L 19/02* (2013.01)

(52) U.S. Cl.
CPC ..... *G10L 19/0204* (2013.01); *H04S 2400/03* (2013.01); *H04S 2400/07* (2013.01)

(58) Field of Classification Search
USPC ..... 381/17, 19, 20, 23; 704/500, 501, 270; 700/94; 375/242
See application file for complete search history.

(56) References Cited

U.S. PATENT DOCUMENTS

| | | | | |
|---|---|---|---|---|
| 8,204,756 | B2 | 6/2012 | Kim et al. | |
| 8,364,497 | B2 | 1/2013 | Beack et al. | |
| 2005/0195981 | A1 | 9/2005 | Faller et al. | |
| 2007/0121954 | A1* | 5/2007 | Kim | G10L 19/008 381/22 |
| 2009/0110203 | A1 | 4/2009 | Taleb | |
| 2011/0046964 | A1* | 2/2011 | Moon | G10L 19/008 704/500 |
| 2011/0103592 | A1 | 5/2011 | Kim et al. | |
| 2011/0112829 | A1 | 5/2011 | Lee et al. | |
| 2017/0134873 | A1 | 5/2017 | Beack et al. | |

FOREIGN PATENT DOCUMENTS

| | | | |
|---|---|---|---|
| WO | WO 2007/111568 | A2 | 10/2007 |
| WO | WO 2010/050740 | A2 | 5/2010 |
| WO | WO 2016/003206 | A1 | 1/2016 |

OTHER PUBLICATIONS

International Search Report dated Aug. 27, 2015 in counterpart International Application No. PCT/KR2015/006788 (4 pages in Korean).

Breebaart et al., "MPEG Spatial Audio Coding/MPEG surround Overview and Current Status," Audio Engineering Society Convention Paper, Oct. 7-10, 2005, New York, USA, pp. 1-17.

ISO/IEC CD 23008-3, "Information technology—High efficiency coding and media delivery in heterogeneous environments—Part 3: 3D audio," ISO/IEC JTC 1/SC29/WG 11, Apr. 4, 2014, 283 pages.

ISO/IEC FDIS 23003-3:2011(E), "Information technology—MPEG audio technologies—Part 3: Unified speech and audio coding," ISO/IEC JTC 1/SC 29/WG 11, Sep. 20, 2011, 291 pages.

ISO/IEC FDIS 23003-1:2006(E), "Information technology—MPEG audio technologies Part 1: MPEG Surround," ISO/IEC JTC 1/SC 29/WG 11, Jul. 21, 2006, 289 pages.

* cited by examiner

FIG. 2

| Processing context | Functional block | Processing domain |
|---|---|---|
| Audio core | MPEG-H 3D Audio core coder | FD or TD |
| Rendering | DRC-1 | if multiband: FD<br>else: neutral |
| | Format converter (FC) | FD |
| | Object renderer | neutral |
| | SAOC 3D decoder | FD |
| | HOA decoder | TD |
| Mixing | Mixer | neutral |
| Post-processing | DRC-1 | if multiband: FD<br>else: neutral |
| | FD binauralizer | FD |
| | TD binauralizer | TD |
| End of chain | DRC-3 (only singleband) | TD |
| | Loudness normalization | TD |
| | Peak limiter | TD |
| | LS distance compensation | TD |

<FCE : Four channel element>

<TCE : Three channel element>

<SiCE : Six channel element>

MULTICHANNEL AUDIO SIGNAL PROCESSING METHOD AND DEVICE

CROSS-REFERENCE TO RELATED APPLICATIONS

This application is a continuation of U.S. patent application Ser. No. 15/870,700, filed on Jan. 12, 2018, which is a continuation of U.S. patent application Ser. No. 15/323,028, filed on Dec. 29, 2016, which claims the benefit under 35 USC 119(a) of PCT Application No. PCT/KR2015/006788, filed on Jul. 1, 2015, which claims the benefit of Korean Patent Application Nos. 10-2014-0082030 filed Jul. 1, 2014 and 10-2015-0094195 filed Jul. 1, 2015, in the Korean Intellectual Property Office, the entire disclosure of which are incorporated herein by reference for all purposes.

TECHNICAL FIELD

Example embodiments relate to a multi-channel audio signal processing method and apparatus, and more particularly, to a method and apparatus for further effectively processing a multi-channel audio signal through an N-N/2-N structure.

RELATED ART

MPEG Surround (MPS) is an audio codec for coding a multi-channel signal, such as a 5.1 channel and a 7.1 channel, which is an encoding and decoding technique for compressing and transmitting the multi-channel signal at a high compression ratio. MPS has a constraint of backward compatibility in encoding and decoding processes. Thus, a bitstream compressed via MPS and transmitted to a decoder is required to satisfy a constraint that the bitstream is reproduced in a mono or stereo format even with a previous audio codec.

Accordingly, even though the number of input channels forming a multi-channel signal increases, a bitstream transmitted to a decoder needs to include an encoded mono signal or stereo signal. The decoder may further receive additional information in order to upmix the mono signal or stereo signal transmitted through the bitstream. The decoder may reconstruct the multi-channel signal from the mono signal or stereo signal using the additional information.

However, with an increasing request for the use of a multi-channel audio signal of 5.1 channel or 7.1 channel or more, processing the multi-channel audio signal using a structure defined in the existing MPS has caused a degradation in the quality of an audio signal.

DETAILED DESCRIPTION

Technical Subject

Embodiments provide a method and system for processing a multi-channel audio signal through an N-N/2-N structure.

Technical Solution

According to an aspect, there is provided a method of processing a multi-channel audio signal, the method including identifying a residual signal and N/2 channel downmix signals generated from N channel input signals, applying the N/2 channel downmix signals and the residual signal to a first matrix, outputting a first signal that is input to each of N/2 decorrelators corresponding to N/2 one-to-two (OTT) boxes through the first matrix and a second output signal that is transmitted to a second matrix without being input to the N/2 decorrelators, outputting a decorrelated signal from the first signal through the N/2 decorrelators, applying the decorrelated signal and the second signal to the second matrix, and generating N channel output signals through the second matrix.

When a Low Frequency Enhancement (LFE) channel is not included in the N channel output signals, the N/2 decorrelators may correspond to the N/2 OTT boxes.

When the number of decorrelators exceeds a reference value of a modulo operation, indices of the decorrelators may be repeatedly reused based on the reference value.

When an LFE channel is included in the N channel output signals, the decorrelators corresponding to the remaining number excluding the number of LFE channels from N/2 may be used, and the LTE channel may not use an OTT box decorrelator.

When a temporal shaping tool is not used, a single vector including the second signal, the decorrelated signal derived from the decorrelator, and the residual signal derived from the decorrelator may be input to the second matrix.

When a temporal shaping tool is used, a vector corresponding to a direct signal including the second signal and the residual signal derived from the decorrelator and a vector corresponding to a diffuse signal including the decorrelated signal derived from the decorrelator may be input to the second matrix.

The generating of the N channel output signals may include shaping a temporal envelope of an output signal by applying a scale factor based on the diffuse signal and the direct signal to a diffuse signal portion of the output signal, when a Subband Domain Time Processing (STP) is used.

The generating of the N channel output signals may include flattening and reshaping an envelope corresponding to a direct signal portion for each channel of N channel output signals when a Guided Envelope Shaping (GES) is used.

A size of the first matrix may be determined based on the number of downmix signal channels and the number of decorrelators to which the first matrix is to be applied, and an element of the first matrix may be determined based on a Channel Level Difference (CLD) parameter or a Channel Prediction Coefficient (CPC) parameter.

According to another aspect, there is provided a method of processing a multi-channel audio signal, the method including identifying N/2 channel downmix signals and N/2 channel residual signals, generating N channel output signals by inputting the N/2 channel downmix signals and the N/2 channel residual signals to N/2 OTT boxes, wherein the N/2 OTT boxes are disposed in parallel without mutual connection, an OTT box to output an LFE channel among the N/2 OTT boxes is configured to (1) receive a downmix signal aside from a residual signal, (2) use a CLD parameter between the CLD parameter and an Inter channel Correlation/Coherence (ICC) parameter, and (3) not output a decorrelated signal through a decorrelator.

According to still another aspect, there is provided an apparatus for processing a multi-channel audio signal, the apparatus including a processor configured to perform a multi-channel audio signal processing method, wherein the multi-channel audio signal processing method includes identifying a residual signal and N/2 channel downmix signals generated from N channel input signals, applying the N/2 channel downmix signals and the residual signal to a first matrix, outputting a first signal that is input to each of N/2 decorrelators corresponding to N/2 OTT boxes through the first matrix and a second output signal that is transmitted to a second matrix without being input to the N/2 decorrelators, outputting a decorrelated signal from the first signal through the N/2 decorrelators, applying the decorrelated signal and the second signal to the second matrix, and generating N channel output signals through the second matrix.

When an LFE channel is not included in the N channel output signals, the N/2 decorrelators may correspond to the N/2 OTT boxes.

When the number of decorrelators exceeds a reference value of a modulo operation, indices of the decorrelators may be repeatedly recycled based on the reference value.

When the LFE channel is included in the N channel output signals, the decorrelators corresponding to the remaining number excluding the number of LFE channels from N/2 may be used, and the LTE channel may not use an OTT box decorrelator.

When a temporal shaping tool is not used, a single vector including the second signal, the decorrelated signal derived from the decorrelator, and the residual signal derived from the decorrelator may be input to the second matrix.

When a temporal shaping tool is used, a vector corresponding to a direct signal including the second signal and the residual signal derived from the decorrelator and a vector corresponding to a diffuse signal including the decorrelated signal derived from the decorrelator may be input to the second matrix.

The generating of the N channel output signals may include shaping a temporal envelope of an output signal by applying a scale factor based on the diffuse signal and the direct signal to a diffuse signal portion of the output signal, when an STP is used.

The generating of the N channel output signals may include flattening and reshaping an envelope corresponding to a direct signal portion for each channel of N channel output signals when a GES is used.

A size of the first matrix may be determined based on the number of downmix signal channels and the number of decorrelators to which the first matrix is to be applied, and an element of the first matrix may be determined based on a CLD parameter or a CPC parameter.

According to still another aspect, there is provided an apparatus for processing a multi-channel audio signal, the apparatus including a processor configured to perform a multi-channel audio signal processing method, wherein the multi-channel audio signal processing method includes identifying N/2 channel downmix signals and N/2 channel residual signals; generating N channel output signals by inputting the N/2 channel downmix signals and the N/2 channel residual signals to N/2 one-to-two (OTT) boxes.

The N/2 OTT boxes are disposed in parallel without mutual connection, and an OTT box to output a Low Frequency Enhancement (LFE) channel among the N/2 OTT boxes is configured to (1) receive a downmix signal aside from a residual signal, (2) use a Channel Level Difference (CLD) parameter between the CLD parameter and an Inter channel Correlation/Coherence (ICC) parameter, and (3) not output a decorrelated signal through a decorrelator.

Effect of Invention

According to embodiments, it is possible to further effectively process audio signals of more channels than the number of channels defined in MPEG Surround (MPS) by processing a multi-channel audio signal through an N-N/2-N structure.

BRIEF DESCRIPTION OF DRAWINGS

FIG. 2 illustrates a domain processed by a 3D audio decoder according to an embodiment.

DETAILED DESCRIPTION TO CARRY OUT THE INVENTION

Hereinafter, embodiments will be described with reference to the accompanying drawings.

Figure 1:
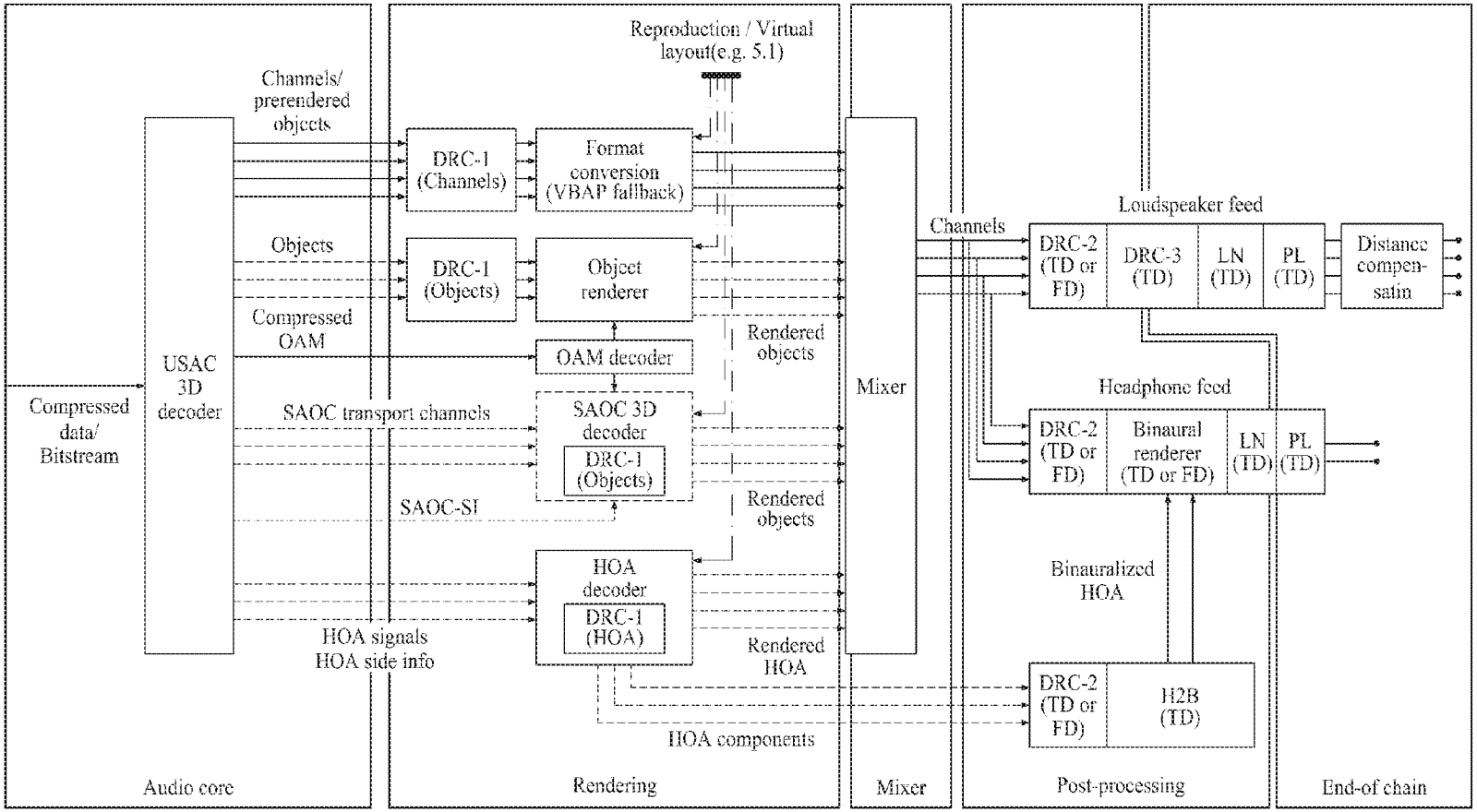
FIG. 1 illustrates a three-dimensional (3D) audio decoder according to an embodiment.

FIG. 1 is a diagram illustrating a three-dimensional (3D) audio decoder according to an embodiment.

According to embodiments, an encoder may downmix a multi-channel audio signal, and a decoder may recover the multi-channel audio signal by upmixing a downmix signal. A description relating to the decoder among the following embodiments to be provided with reference to FIGS. 2 through 29 may correspond to FIG. 1. Meanwhile, FIGS. 2 through 29 illustrate a process of processing a multi-channel audio signal and thus, may correspond to any one constituent component of a bitstream, a Unified Speech and Audio Coding (USAC) 3D decoder, DRC-1, and format conversion.

FIG. 2 illustrates a domain processed by a 3D audio decoder according to an embodiment.

The USAC decoder of FIG. 1 is used for coding a core band and processes an audio signal in one of a time domain and a frequency band. Further, when the audio signal is a multiband signal, DRC-1 processes the audio signal in the frequency domain. The format conversion processes the audio signal in the frequency band.

Figure 3:
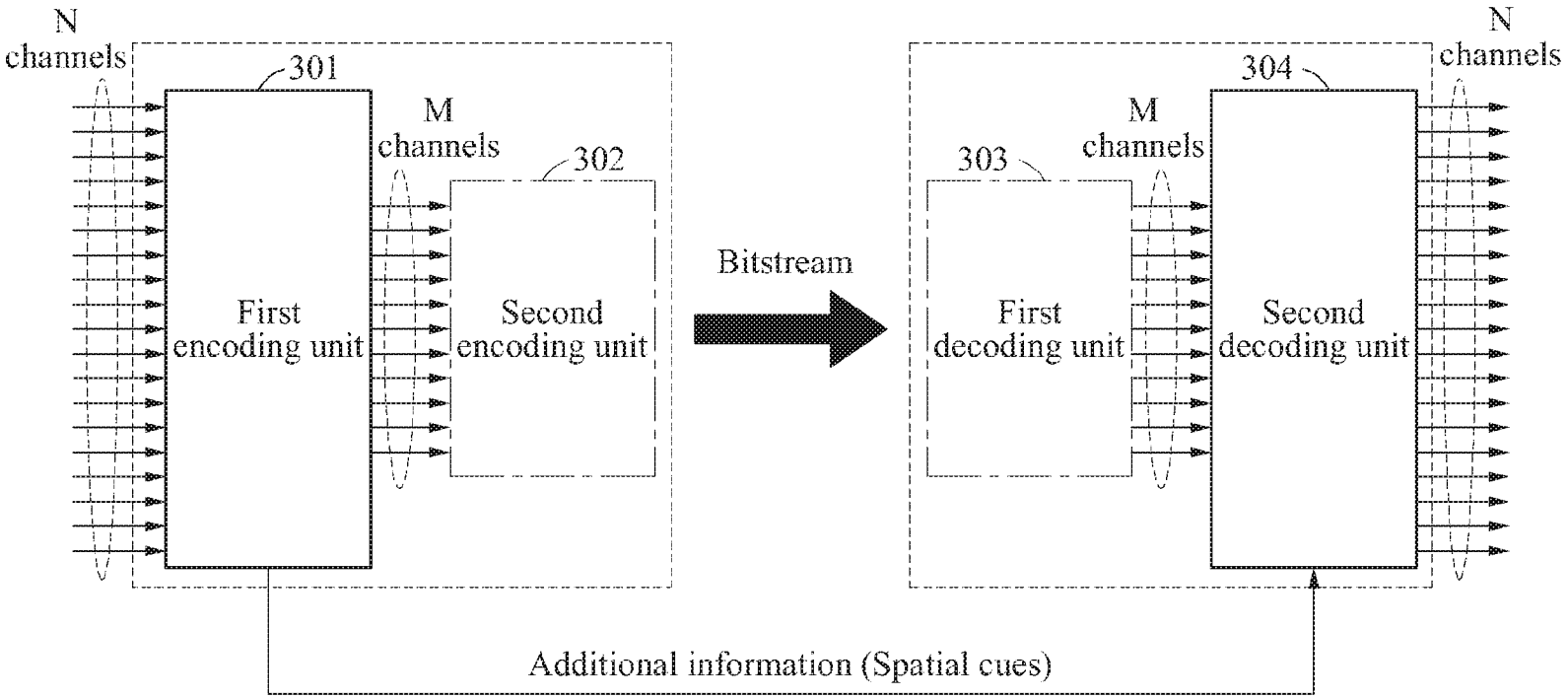
FIG. 3 illustrates a Unified Speech and Audio Coding (USAC) 3D encoder and a USAC 3D decoder according to an embodiment.

FIG. 3 illustrates a USAC 3D encoder and a USAC 3D decoder according to an embodiment.

Referring to FIG. 3, the USAC 3D encoder may include a first encoding unit 301 and a second encoding unit 302. Alternatively, the USAC 3D encoder may include the second encoding unit 302. Likewise, the USAC 3D decoder may include a first decoding unit 303 and a second decoding unit 304. Alternatively, the USAC 3D encoder may include the first decoding unit 303.

N channel input signals may be input to the first encoding unit 301. The first encoding unit 301 may downmix the N channel input signals to output M channel downmix signals. Here, N may be greater than M. For example, if N is an even number, M may be N/2. Alternatively, if N is an odd number, M may be (N−1)/2+1. That is, Equation 1 may be provided.

$$M = \frac{N}{2} \ (N \text{ is even}), \qquad \text{[Equation 1]}$$

$$M = \frac{N-1}{2} + 1 \ (N \text{ is odd})$$

The second encoding unit 302 may encode the M channel downmix signals to generate a bitstream. For instance, the second encoding unit 302 may encode the M channel downmix signals. Here, a general audio coder may be utilized. For example, when the second encoding unit 302 is an Extended HE-AAC USAC coder, the second encoding unit 302 may encode and transmit 24 channel signals.

Here, when the N channel input signals are encoded using the second encoding unit 302, relatively greater bits are needed than when the N channel input signals are encoded using both the first encoding unit 301 and the second encoding unit 302, and sound quality may be degraded.

Meanwhile, the first decoding unit 303 may decode the bitstream generated by the second encoding unit 302 to output the M channel downmix signals. The second decoding unit 304 may upmix the M channel downmix signals to generate the N channel output signals. The second decoding unit 302 may decode the M channel output signals to generate a bitstream. The N channel output signals may be recovered to be similar to the N channel input signals that are input to the first encoding unit 301.

For example, the second decoding unit 304 may decode the M channel downmix signals. Here, a general audio coder may be utilized. For instance, when the second decoding unit 304 is an Extended HE-AAC USAC coder, the second decoding unit 302 may decode 24 channel downmix signals.

Figure 4:
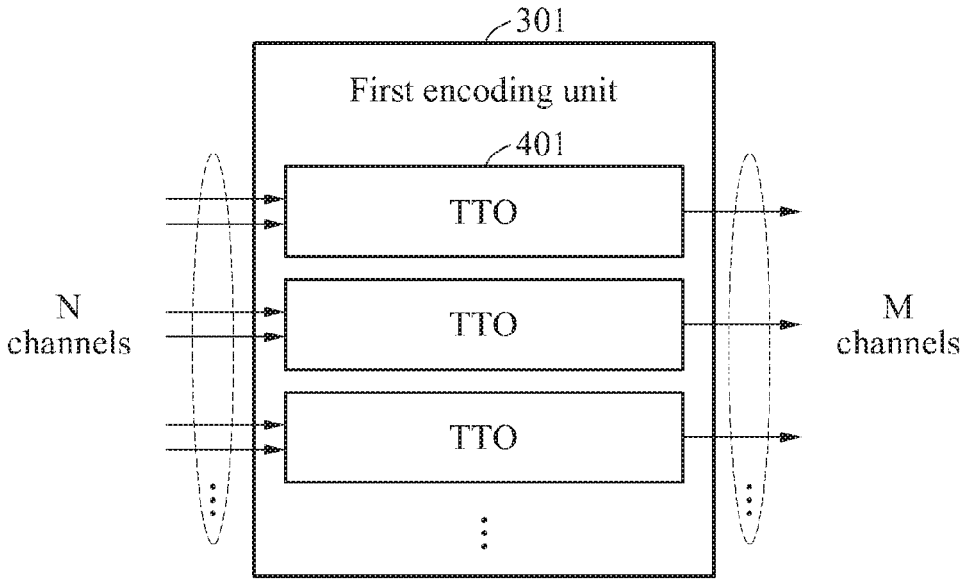
FIG. 4 is a first diagram illustrating a configuration of a first encoding unit of FIG. 3 in detail according to an embodiment.

FIG. 4 is a first diagram illustrating a configuration of the first encoding unit of FIG. 3 in detail according to an embodiment.

The first encoding unit 301 may include a plurality of downmixing units 401. Here, the N channel input signals input to the first encoding unit 301 may be input in pairs to the downmixing units 401. The downmixing units 401 may each represent a two-to-one (TTO) box. Each of the downmixing units 401 may generate a single channel (mono) downmix signal by extracting a spatial cue, such as Channel Level Difference (CLD), Inter Channel Correlation/Coherence (ICC), Inter Channel Phase Difference (IPD), Channel Prediction Coefficient (CPC), or Overall Phase Difference (OPD), from the two input channel signals and by downmixing the two channel (stereo) input signals.

The downmixing units 401 included in the first encoding unit 301 may configure a parallel structure. For instance, when N channel input signals are input to the first encoding unit 301 where N is an even number, N/2 TTO downmixing units 401 each provided in a TTO box may be needed for the first encoding unit 301.

Figure 5:
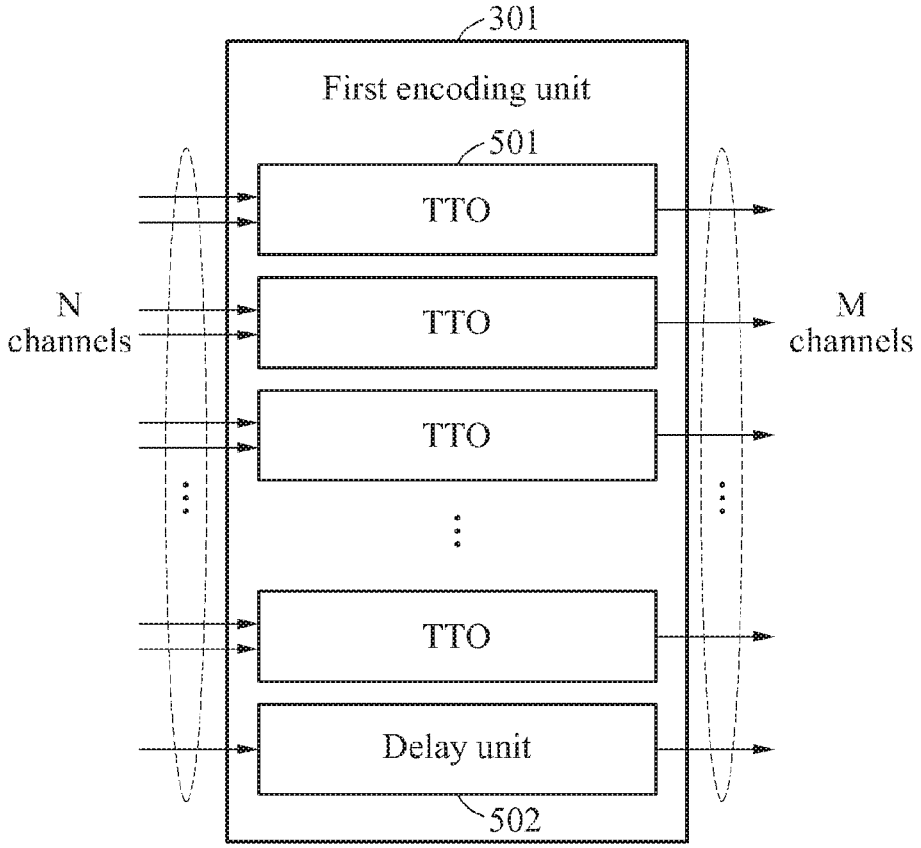
FIG. 5 is a second diagram illustrating a configuration of the first encoding unit of FIG. 3 in detail according to an embodiment.

FIG. 5 is a second diagram illustrating a configuration of the first encoding unit of FIG. 3 in detail according to an embodiment.

FIG. 4 illustrates the detailed configuration of the first encoding unit 301 in an example in which N channel input signals are input to the first encoding unit 301 where N is an even number. FIG. 5 illustrates the detailed configuration of the first encoding unit 301 in an example in which N channel input signals are input to the first encoding unit 301 where N is an odd number.

Referring to FIG. 5, the first encoding unit 301 may include a plurality of downmixing units 501. Here, the first encoding unit 301 may include (N−1)/2 downmixing units 501. The first encoding unit 301 may include a delay unit 502 for processing a single remaining channel signal.

Here, the N channel input signals input to the first encoding unit 301 may be input in pairs to the downmixing units 501. The downmixing units 501 may each represent a TTO box. Each of the downmixing units 501 may generate a single channel (mono) downmix signal by extracting a spatial cue, such as CLD, ICC, IPD, CPC, or OPD, from the two input channel signals and by downmixing the two channel (stereo) signals. The M channel downmix signals output from the first encoding unit 301 may be determined based on the number of downmixing units 501 and the number of delay units 502.

A delay value applied to the delay unit 502 may be the same as a delay value applied to the downmixing units 501. If M channel downmix signals output from the first encoding unit 301 are a pulse-code modulation (PCM) signal, the delay value may be determined according to Equation 2.

Enc_Delay=Delay1(QMF Analysis)+Delay2(Hybrid QMF Analysis)+Delay3(QMF Synthesis) [Equation 2]

Here, Enc_Delay denotes the delay value applied to the downmixing units 501 and the delay unit 502. Delay1 (QMF Analysis) denotes a delay value generated when quadrature mirror filter (QMF) analysis is performed on 64 bands of MPEG Surround (MPS), which may be 288. Delay2 (Hybrid QMF Analysis) denotes a delay value generated in Hybrid QMF analysis using a 13-tap filter, which may be 6*64=384. Here, 64 is applied because hybrid QMF analysis is performed after QMF analysis is performed on the 64 bands.

If the M channel downmix signals output from the first encoding unit 301 are QMF signals, the delay value may be determined according to Equation 3.

Enc_Delay=Delay1(QMF Analysis)+Delay2(Hybrid QMF Analysis) [Equation 3]

Figure 6:
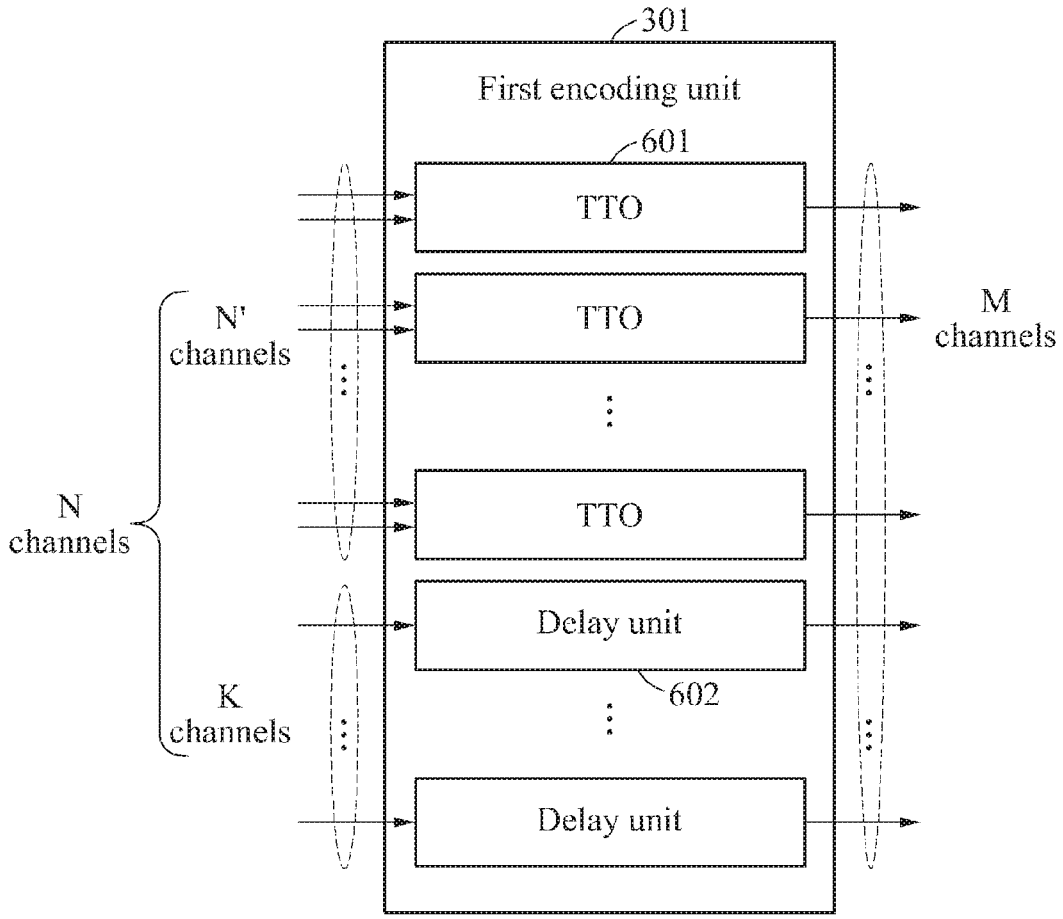
FIG. 6 is a third diagram illustrating a configuration of the first encoding unit of FIG. 3 in detail according to an embodiment.
Figure 7:
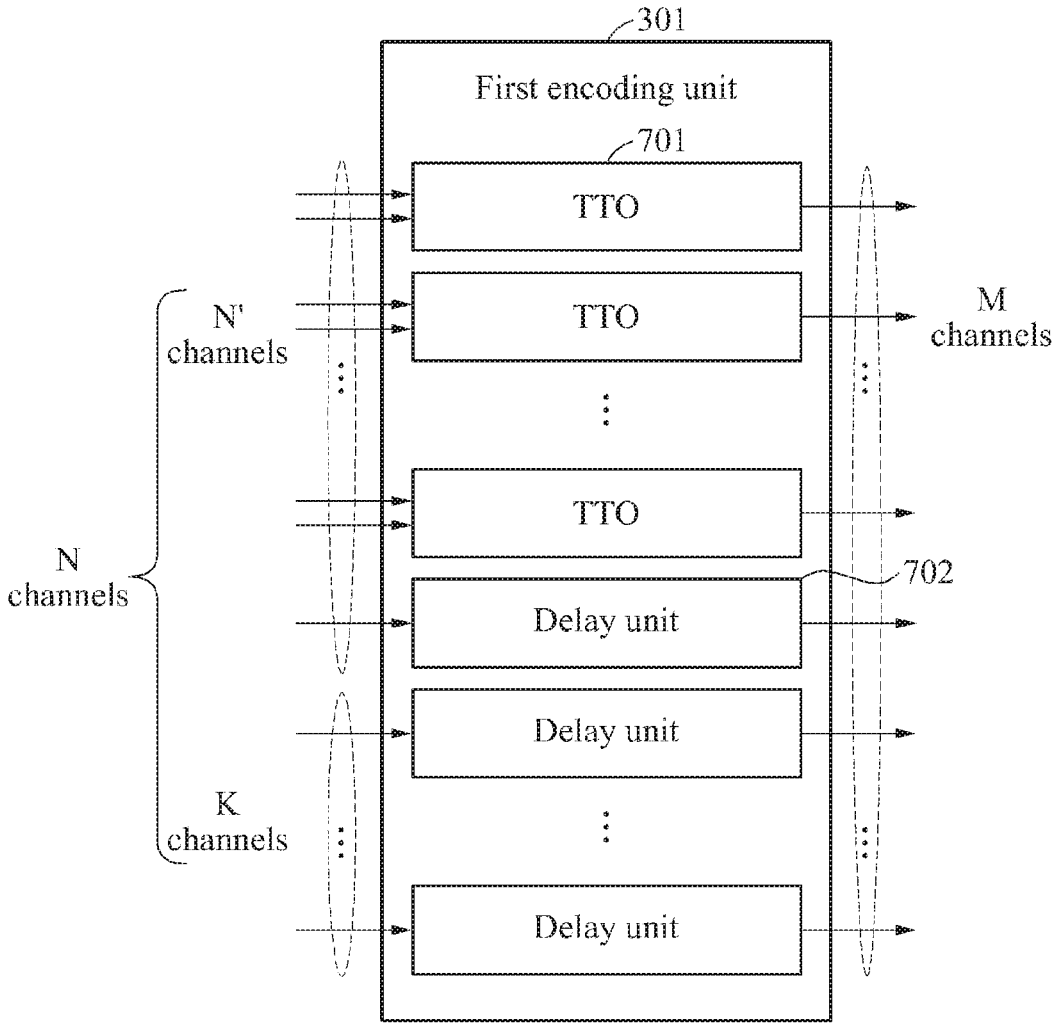
FIG. 7 is a fourth diagram illustrating a configuration of the first encoding unit of FIG. 3 in detail according to an embodiment.

FIG. 6 is a third diagram illustrating a configuration of the first encoding unit of FIG. 3 in detail according to an embodiment. FIG. 7 is a fourth diagram illustrating a configuration of the first encoding unit of FIG. 3 in detail according to an embodiment.

It is assumed that N channel input signals include N' channel input signals and K channel input signals, and the N' channel input signals are input to the first encoding unit 301, and the K channel input signals are not input to the first encoding unit 301.

In this case, M that is the number of channels corresponding to M channel downmix signals input to the second encoding unit 302 may be determined according to Equation 4.

$$M = \frac{N'}{2}K \ (N' \text{ is even}), \quad M = \frac{N'-1}{2} + 1 + K \ (N' \text{ is odd}) \qquad \text{[Equation 4]}$$

Here, FIG. 6 illustrates the configuration of the first encoding unit 301 when N' is an even number, and FIG. 7 illustrates the configuration of the first encoding unit 301 when N' is an odd number.

According to FIG. 6, when N' is an even number, the N' channel input signals may be input to a plurality of downmixing units 601 and the K channel input signals may be input to a plurality of delay units 602. Here, the N' channel input signals may be input to N'/2 downmixing units 601 each representing a TTO box and the K channel input signals may be input to K delay units 602.

According to FIG. 7, when N' is an odd number, the N' channel input signals may be input to a plurality of downmixing units 701 and a single delay unit 702. K channel input signals may be input to a plurality of delay units 702. Here, the N' channel input signals may be input to N'/2 downmixing units 701 each representing a TTO box and the single delay unit 702. The K channel input signals may be input to K delay units 702, respectively.

Figure 8:
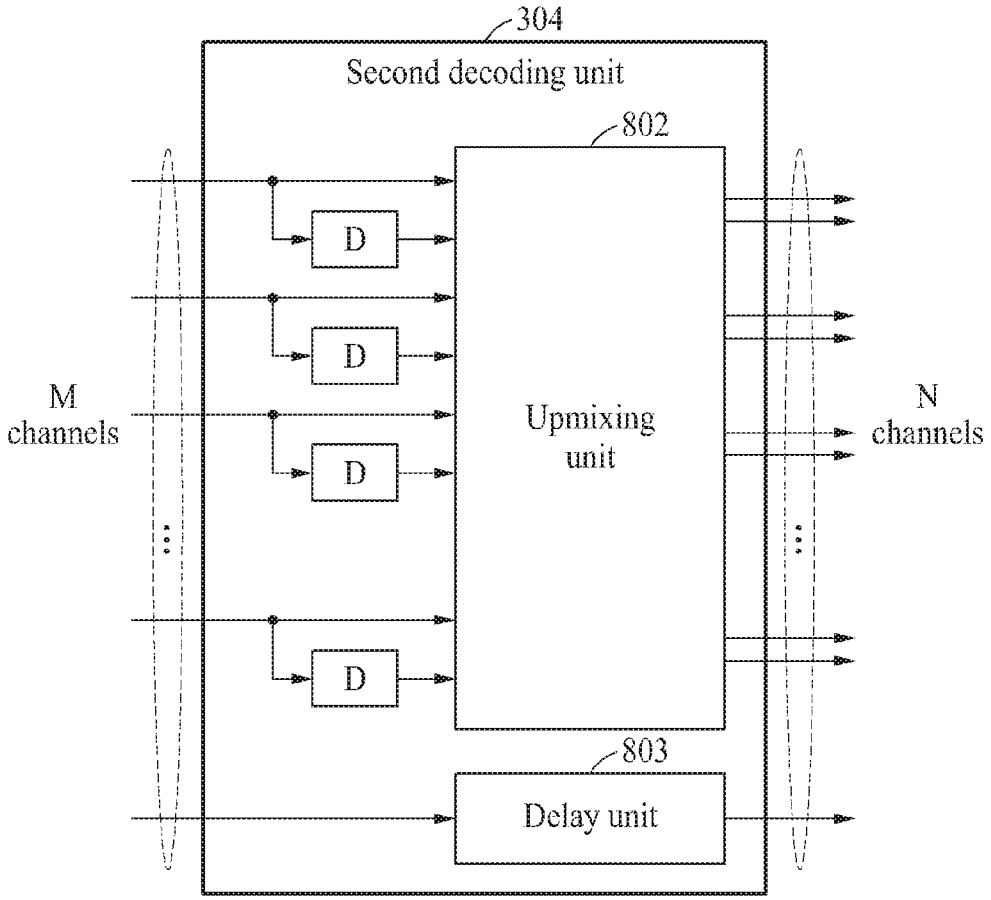
FIG. 8 is a first diagram illustrating a configuration of a second decoding unit of FIG. 3 in detail according to an embodiment.

FIG. 8 is a first diagram illustrating a configuration of the second decoding unit of FIG. 3 in detail according to an embodiment.

Referring to FIG. 8, the second decoding unit 304 may generate N channel output signals by upmixing M channel downmix signals transmitted from the first decoding unit 303. The first decoding unit 303 may decode M channel downmix signals included in a bitstream. Here, the second decoding unit 304 may generate the N channel output signals by upmixing the M channel downmix signals using a spatial cue transmitted from the second encoding unit 301 of FIG. 3.

For instance, when N is an even number in the N channel output signals, the second decoding unit 304 may include a plurality of decorrelation units 801 and an upmixing unit 802. When N is an odd number, the second decoding unit 304 may include a plurality of decorrelation units 801, an upmixing unit 802 and a delay unit 803. That is, when N is an even number, the delay unit 803 illustrated in FIG. 8 may be unnecessary.

Here, since an additional delay may occur while the decorrelation units 801 generate a decorrelated signal, a delay value of the delay unit 803 may be different from a delay value applied in the encoder. FIG. 8 illustrates that the second decoding unit 304 outputs the N channel output signals, wherein N is an odd number.

If the N channel output signals output from the second encoding unit 304 are a PCM signal, the delay value of the delay unit 803 may be determined according to Equation 5.

Dec_Delay=Delay1(QMF Analysis)+Delay2(Hybrid QMF Analysis)+Delay3(QMF Synthesis)+Delay4(Decorrelator filtering delay) [Equation 5]

Here, Dec_Delay denotes the delay value of the delay unit 803. Delay1 denotes a delay value generated by QMF analysis, Delay2 denotes a delay value generated by hybrid QMF analysis, and Delay3 denotes a delay value generated by QMF synthesis. Delay4 denotes a delay value generated when the decorrelation units 801 apply a decorrelation filter.

If the N channel output signals output from the second encoding unit 304 are a QMF signal, the delay value of the delay unit 803 may be determined according to Equation 6.

Dec_Delay=Delay3(QMF Synthesis)+Delay4(Decorrelator filtering delay) [Equation 6]

Initially, each of the decorrelation units 801 may generate a decorrelated signal from the M channel downmix signals input to the second decoding unit 304. The decorrelated signal generated by each of the decorrelation units 801 may be input to the upmixing unit 802.

Here, unlike the MPS generating a decorrelated signal, the plurality of decorrelation units 801 may generate decorrelated signals using the M channel downmix signals. That is, when the M channel downmix signals transmitted from the encoder are used to generate the decorrelated signals, sound quality may not be deteriorated when the sound field of multi-channel signals is reproduced.

Hereinafter, operations of the upmixing unit 802 included in the second encoding unit 304 will be described. The M channel downmix signals input to the second decoding unit 304 may be defined as $m(n)=[m_0(n), m_1(n), \ldots, m_{M-1}(n)]^T$. M decorrelated signals generated using the M channel downmix signals may be defined as $d(n)=[d_{m_0}(n), d_{m_1}(n), \ldots, d_{m_{M-1}}(n)]^T$. Further, N channel output signals output through the second decoding unit 304 may be defined as $y(n)=[y_0(n), y_1(n), \ldots, y_{M-1}(n)]^T$.

The second decoding unit 304 may output the N channel output signals according to Equation 7.

$$y(n)=M(n)\times[m(n)\square d(n)] \quad \text{[Equation 7]}$$

Here, M(n) denotes a matrix for upmixing the M channel downmix signals in n sample times. Here, M(n) may be defined as expressed by Equation 8.

$$\begin{bmatrix} R_0(n) & 0 & \cdots & & 0 \\ 0 & \ddots & & & \\ \vdots & & R_i(n) & & \vdots \\ & & & \ddots & 0 \\ 0 & & \cdots & 0 & R_{M-1}(n) \end{bmatrix} \quad \text{[Equation 8]}$$

In Equation 8, 0 denotes a 2×2 zero matrix, and $R_i(n)$ denotes a 2×2 matrix and may be defined as expressed by Equation 9.

$$R_i(n)=\begin{bmatrix} H^i_{LL}(n) & H^i_{LR}(n) \\ H^i_{RL}(n) & H^i_{RR}(n) \end{bmatrix}=\begin{bmatrix} H^i_{LL}(b) & H^i_{LR}(b) \\ H^i_{RL}(b) & H^i_{RR}(b) \end{bmatrix}+(1-\delta(n))\begin{bmatrix} H^i_{LL}(b-1) & H^i_{LR}(b-1) \\ H^i_{RL}(b-1) & H^i_{RR}(b-1) \end{bmatrix} \quad \text{[Equation 9]}$$

Here, a component of $R_i(n)$, $\{H_{LL}^i(b), H_{LR}^i(b), H_{RL}^i(b), H_{RR}^i(b)\}$, may be derived from the spatial cue transmitted from the encoder. The spatial cue actually transmitted from the encoder may be determined for each b index that is a frame unit, and $R_i(n)$, applied by a sample unit, may be determined by interpolation between neighboring frames.

$\{H_{LL}^i(b), H_{LR}^i(b), H_{RL}^i(b), H_{RR}^i(b)\}$ may be determined using an MPS method according to Equation 10.

$$\begin{bmatrix} H^i_{LL}(b) & H^i_{LR}(b) \\ H^i_{RL}(b) & H^i_{RR}(b) \end{bmatrix}= \quad \text{[Equation 10]}$$

-continued $$\begin{bmatrix} c_L(b)\cdot\cos(\alpha(b)+\beta(b)) & c_L(b)\cdot\sin(\alpha(b)+\beta(b)) \\ c_R(b)\cdot\cos(\beta(b)-\alpha(b)) & c_L(b)\cdot\sin(\beta(b)-\alpha(b)) \end{bmatrix}$$

In Equation 10, $C_{L,R}$ may be derived from CLD. $\alpha(b)$ and $\beta(b)$ may be derived from CLD and ICC. Equation 10 may be derived according to a method of processing a spatial cue defined in MPS.

In Equation 7, operator □ denotes an operator for generating a new vector column by interlacing components of vectors. In Equation 7, [m(n)□d(n)] may be determined according to Equation 11.

$$v(n)=[m(n)\square d(n)]=[m_0(n),d_{m_0}(n),m_1(n),d_{m_1}(n),\ldots,m_{M-1}(n),d_{m_{M-1}}(n)]^T \quad \text{[Equation 11]}$$

According to the foregoing process, Equation 7 may be represented as Equation 12.

$$\begin{bmatrix} \begin{Bmatrix} y_0(n) \\ y_1(n) \end{Bmatrix} \\ \vdots \\ \begin{Bmatrix} y_{2i-2}(n) \\ y_{2i-1}(n) \end{Bmatrix} \\ \vdots \\ \begin{Bmatrix} y_{N-2}(n) \\ y_{N-1}(n) \end{Bmatrix} \end{bmatrix} = \begin{bmatrix} \begin{bmatrix} H^0_{LL}(n) & H^0_{LR}(n) \\ H^0_{RL}(n) & H^0_{RR}(n) \end{bmatrix} & 0 & \cdots & & 0 \\ 0 & \ddots & & & \\ \vdots & & \begin{bmatrix} H^i_{LL}(n) & H^i_{LR}(n) \\ H^i_{RL}(n) & H^i_{RR}(n) \end{bmatrix} & & \vdots \\ & & & \ddots & 0 \\ 0 & & \cdots & 0 & \begin{bmatrix} H^{M-1}_{LL}(n) & H^{M-1}_{LR}(n) \\ H^{M-1}_{RL}(n) & H^{M-1}_{RR}(n) \end{bmatrix} \end{bmatrix} \begin{bmatrix} \begin{Bmatrix} m_0(n) \\ d_{m_0}(n) \end{Bmatrix} \\ \begin{Bmatrix} m_1(n) \\ d_{m_1}(n) \end{Bmatrix} \\ \vdots \\ \begin{Bmatrix} m_{M-1}(n) \\ d_{m_{M-1}}(n) \end{Bmatrix} \end{bmatrix} \quad \text{[Equation 12]}$$

In Equation 12, { } is used to clarify processes of processing an input signal and an output signal. By Equation 11, the M channel downmix signals are paired with the decorrelated signals to be inputs of an upmixing matrix in Equation 12. That is, according to Equation 12, the decorrelated signals are applied to the respective M channel downmix signals, thereby minimizing distortion of sound quality in the upmixing process and generating a sound field effect maximally close to the original signals.

Equation 12 described above may also be expressed as Equation 13.

$$\begin{bmatrix} \begin{Bmatrix} y_{2i-2}(n) \\ y_{2i-1}(n) \end{Bmatrix} \end{bmatrix} = \begin{bmatrix} H^i_{LL}(n) & H^i_{LR}(n) \\ H^i_{RL}(n) & H^i_{RR}(n) \end{bmatrix} \begin{bmatrix} \begin{Bmatrix} m_i(n) \\ d_{m_i}(n) \end{Bmatrix} \end{bmatrix} \quad \text{[Equation 13]}$$

Figure 9:
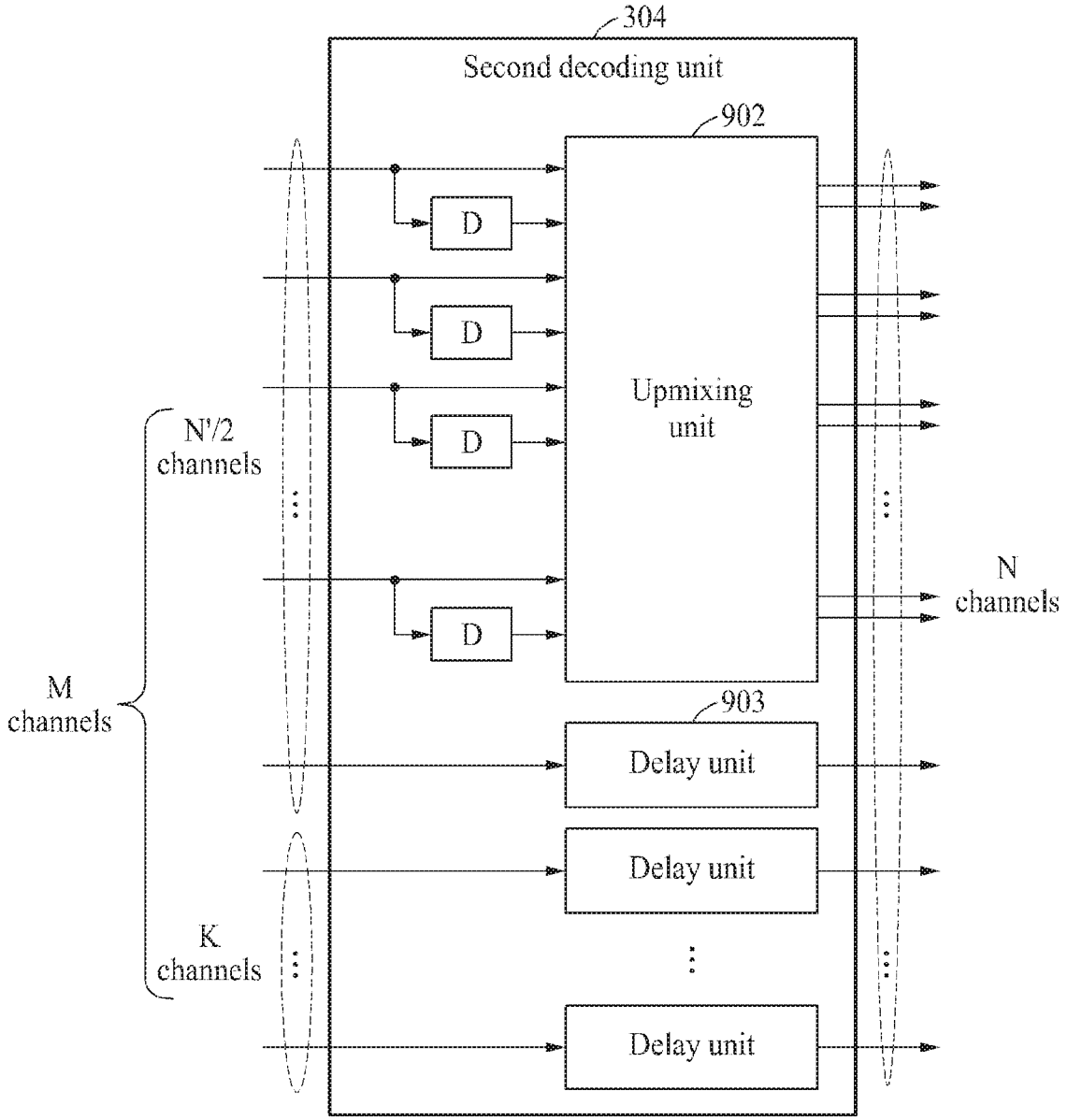
FIG. 9 is a second diagram illustrating a configuration of the second decoding unit of FIG. 3 in detail according to an embodiment.

FIG. 9 is a second diagram illustrating a configuration of the second decoding unit of FIG. 3 in detail according to an embodiment.

Referring to FIG. 9, the second decoding unit 304 may generate N channel output signals by decoding M channel downmix signals transmitted from the first decoding unit 303. When the M channel downmix signals include N'/2 channel audio signals and K channel audio signals, the second decoding unit 304 may also conduct processing by applying a processing result of the encoder.

For instance, when it is assumed that the M channel downmix signals input to the second decoding unit 304 satisfy Equation 4, the second decoding unit 304 may include a plurality of delay units 903 as illustrated in FIG. 9.

Here, when N' is an odd number with respect to the M channel downmix signals satisfying Equation 4, the second decoding unit 304 may have the configuration of FIG. 9. When N' is an even number with respect to the M channel downmix signals satisfying Equation 4, a single delay unit 903 disposed below an upmixing unit 902 may be excluded from the second decoding unit 304 in FIG. 9.

Figure 10:
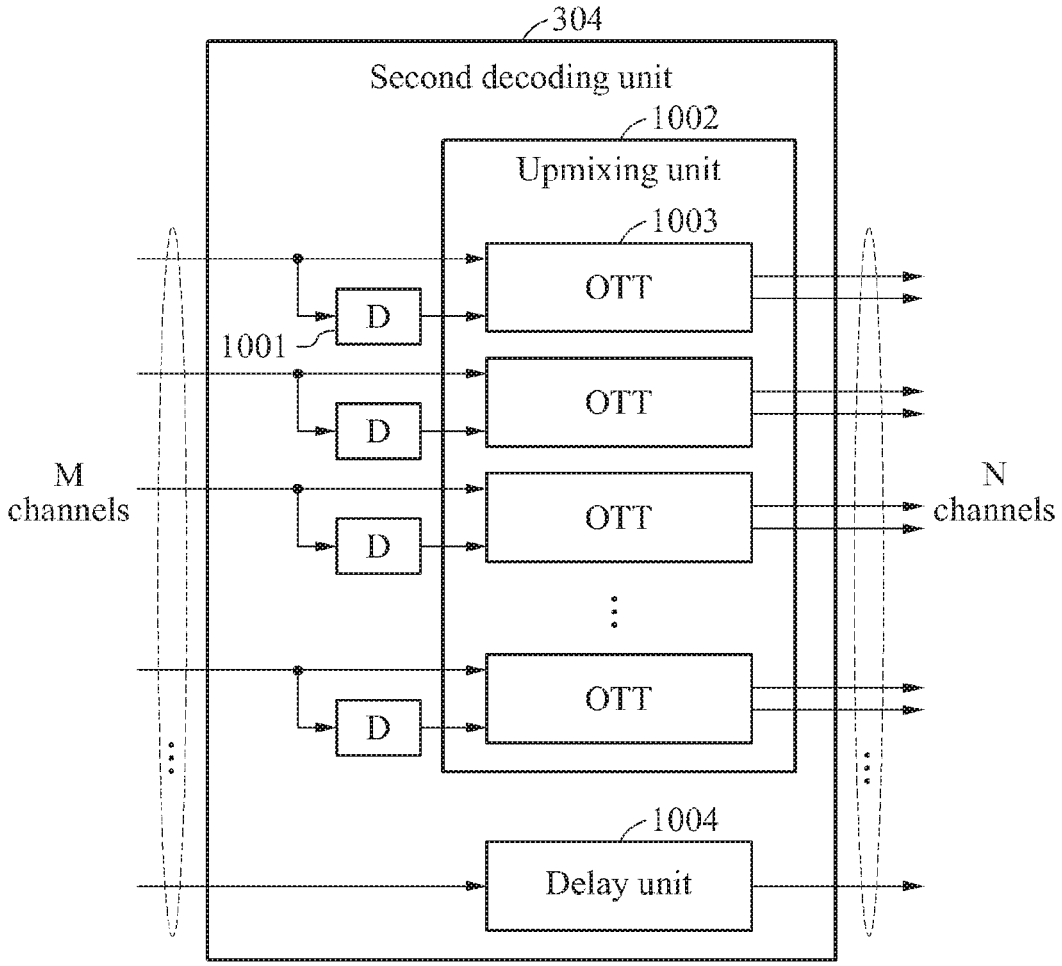
FIG. 10 is a third diagram illustrating a configuration of the second decoding unit of FIG. 3 in detail according to an embodiment.

FIG. 10 is a third diagram illustrating a configuration of the second decoding unit of FIG. 3 in detail according to an embodiment.

Referring to FIG. 10, the second decoding unit 304 may generate N channel output signals by upmixing M channel downmix signals transmitted from the first decoding unit 303. Here, in FIG. 10, an upmixing unit 1002 of the decoding unit 304 may include a plurality of signal processing units 1003 each representing a one-to-two (OTT) box.

Here, each of the signal processing units 1003 may generate two channel output signals using a single channel downmix signal among the M channel downmix signals and a decorrelated signal generated by a decorrelation unit 1001. The signal processing units 1003 disposed in parallel in the upmixing unit 1002 may generate N−1 channel output signals.

If N is an even number, a delay unit 1004 may be excluded from the second decoding unit 304. Accordingly, the signal processing units 1003 disposed in parallel in the upmixing unit 1002 may generate N channel output signals.

The signal processing units 1003 may conduct upmixing according to Equation 13. Upmixing processes performed by all of the signal processing units 1003 may be represented as a single upmixing matrix as in Equation 12.

Figure 11:
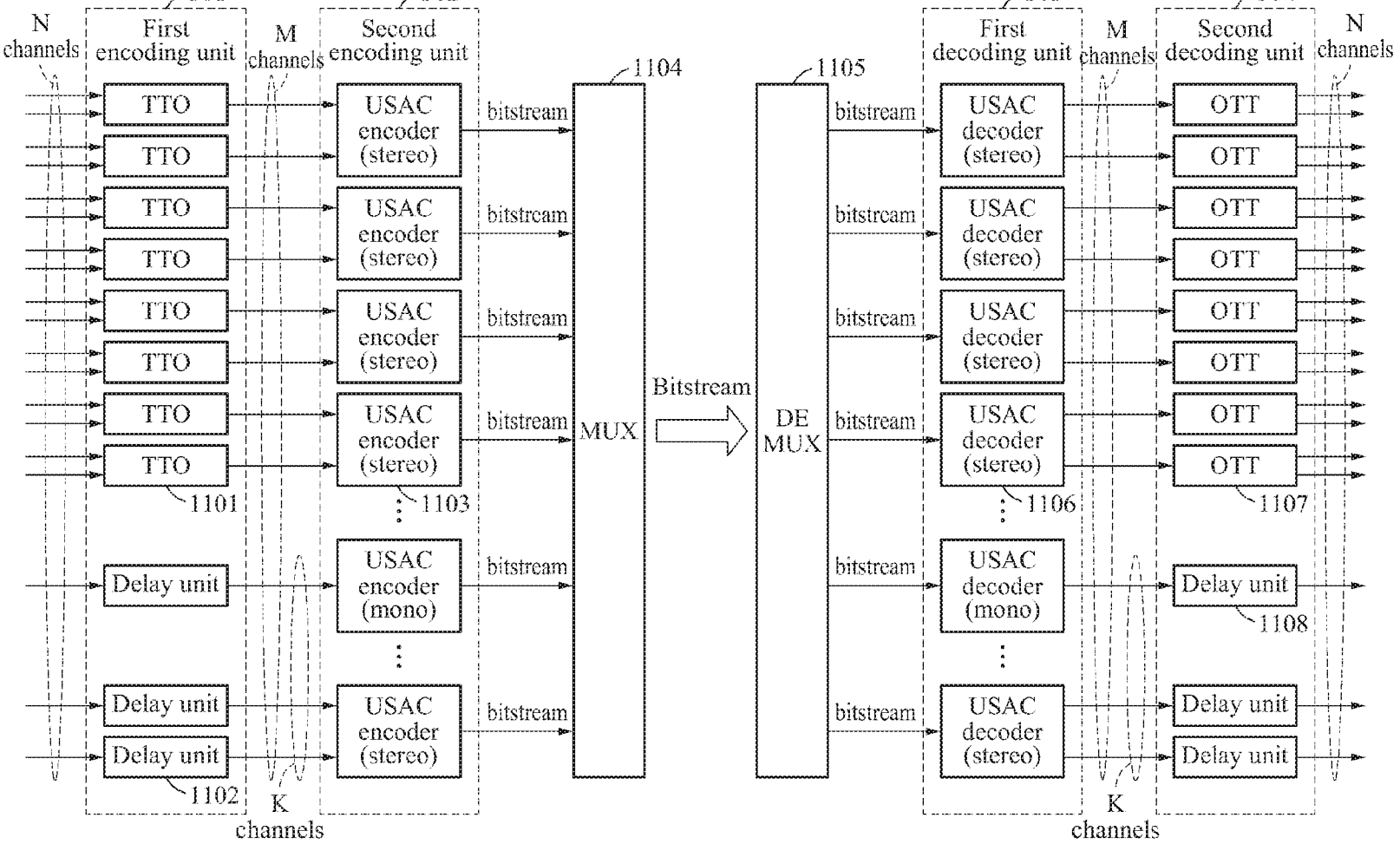
FIG. 11 illustrates an example of realizing FIG. 3 according to an embodiment.

FIG. 11 illustrates an example of realizing FIG. 3 according to an embodiment.

Referring to FIG. 11, the first encoding unit 301 may include a plurality of TTO downmixing units 1101 and a plurality of delay units 1102. The second encoding unit 302 may include a plurality of USAC encoders 1103. The first decoding unit 303 may include a plurality of USAC decoders 1106, and the second decoding unit 304 may include a plurality of OTT box upmixing units 304 and a plurality of delay units 1108.

Referring to FIG. 11, the first encoding unit 301 may output M channel downmix signals using N channel input signals. Here, the M channel downmix signals may be input to the second encoding unit 302. The M channel downmix signals may be input to the second encoding unit 302. Here, among the M channel downmix signals, pairs of 1 channel downmix signals passing through the TTO box downmixing units 1101 may be encoded into stereo forms by the USAC encoders 1103 of the second encoding unit 302.

Among the M channel downmix signals, downmix signals passing through the delay units 1102, instead of the downmixing units 1101, may be encoded into mono or stereo forms by the USAC encoders 1103. That is, among the M channels, single channel downmix signal passing through the delay units 1102 may be encoded into a mono form by the USAC encoders 1103. Among the M channel downmix signals, two 1 channel downmix signals passing through two delay units 1102 may be encoded into stereo forms by the USAC encoders 1103.

The M channel signals may be encoded by the second encoding unit 302 and generated into a plurality of bitstreams. The bitstreams may be reformatted into a single bitstream through a multiplexer 1104.

The bitstream generated by the multiplexer 1104 is transmitted to a demultiplexer 1105, and the demultiplexer 1105 may demultiplex the bitstream into a plurality of bitstreams corresponding to the USAC decoders 303 included in the first decoding unit 303.

The plurality of demultiplexed bitstreams may be input to the respective USAC decoders 1106 in the first decoding unit 303. The USAC decoders 303 may decode the bitstreams according to the same encoding method as used by the USAC encoders 1103 in the second encoding unit 302. The first decoding unit 303 may output M channel downmix signals from the plurality of bitstreams.

Subsequently, the second decoding unit 304 may output N channel output signals using the M channel downmix signals. Here, the second decoding unit 304 may upmix a portion of the input M channel downmix signals using the OTT box upmixing units 1107. In detail, 1 channel downmix signals among the M channel downmix signals are input to the upmixing units 1107, and each of the upmixing units 1107 may generate a 2 channel output signal using a 1 channel downmix signal and a decorrelated signal. For instance, the upmixing units 1107 may generate the two channel output signals using Equation 13.

Meanwhile, each of the upmixing units 1107 may perform upmixing M times using an upmixing matrix corresponding to Equation 13, and accordingly the second decoding unit 304 may generate N channel output signals. Thus, as Equation 12 is derived by performing upmixing based on Equation 13 M times, M of Equation 12 may be the same as the number of upmixing units 1107 included in the second decoding unit 304.

Among the N channel input signals, K channel audio signals may be included in M channel downmix signals through the delay units 1102, instead of the TTO box downmixing units 1101, in the first encoding unit 301. In this case, the K channel audio signals may be processed by the delay units 1108 in the second decoding unit 304, not by the OTT box upmixing units 1107. In this case, the number of output signals channels to be output through the OTT box upmixing units 1107 may be N−K.

Figure 12:
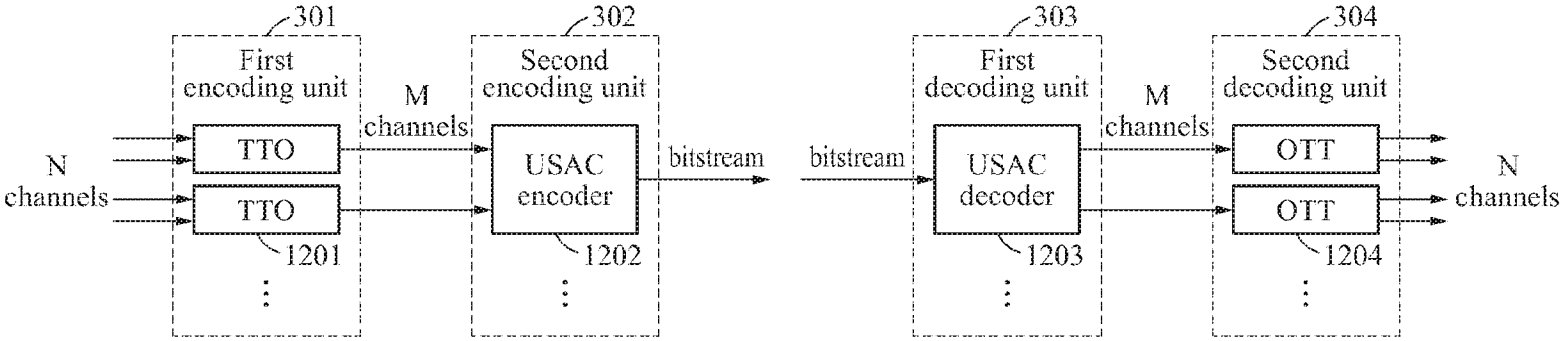
FIG. 12 simplifies FIG. 11 according to an embodiment.

FIG. 12 simplifies FIG. 11 according to an embodiment.

Referring to FIG. 12, N channel input signals may be input in pairs to downmixing units 1201 included in the first encoding unit 301. The downmixing units 1201 may each represent a TTO box and may generate 1 channel downmix signals by downmixing 2 channel input signals. The first encoding unit 301 may generate M channel downmix signals from the N channel input signals using a plurality of downmixing units 1201 disposed in parallel.

A USAC encoder 1202 in a stereo type included in the second encoding unit 302 may generate a bitstream by encoding two 1 channel downmix signals output from the two downmixing units 1201.

A USAC decoder 1203 in a stereo type included in the first decoding unit 303 may recover two 1 channel downmix signals forming M channel downmix signals from the bitstream. The two 1 channel downmix signals may be input to two upmixing units 1204 each representing an OTT box included in the second decoding unit 304. Each of the upmixing units 1204 may output 2 channel output signals forming N channel output signals using a 1 channel downmix signal and a decorrelated signal.

Figure 13:
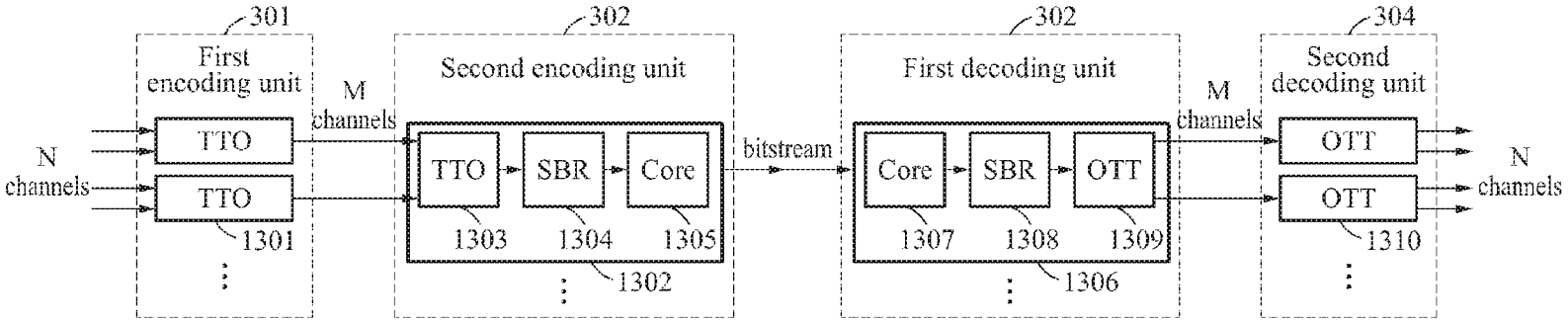
FIG. 13 illustrates a configuration of the second encoding unit and the first decoding unit of FIG. 12 in detail according to an embodiment.

FIG. 13 illustrates a configuration of the second encoding unit and the first decoding unit of FIG. 12 in detail according to an embodiment.

In FIG. 13, a USAC encoder 1302 included in the second encoding unit 302 may include a TTO box downmixing unit 1303, a spectral band replication (SBR) unit 1304, and a core encoding unit 1305.

Downmixing units 1301 included in the first encoding unit 301 and each representing a TTO box may generate 1 channel downmix signals forming M channel downmix signals by downmixing 2 channel input signals among N channel input signals. The number of M channels may be determined based on the number of downmixing units 1301.

Two 1 channel downmix signals output from two downmixing units 1301 in the first encoding unit 301 may be input to the TTO box downmixing unit 1303 in the USAC encoder 1302. The downmixing unit 1303 may generate a single 1 channel downmix signal by downmixing a pair of 1 channel downmix signals output from the two downmixing units 1301.

The SBR unit 1304 may extract only a low-frequency band, except for a high-frequency band, from the mono signal for parameter encoding of the high-frequency band of the mono signal generated by the downmixing unit 1301. The core encoding unit 1305 may generate a bitstream by encoding the low-frequency band of the mono signal corresponding to a core band.

According to the embodiment, a TTO downmixing process may be consecutively performed in order to generate a bitstream including M channel downmix signals from the N channel input signals. That is, the TTO box downmixing units 1301 may downmix stereo typed 2 channel input signals among the N channel input signals. Channel signals output respectively from two downmixing units 1301 may be input as a portion of the M channel downmix signals to the TTO box downmixing unit 1303. That is, among the N channel input signals, 4 channel input signals may be output as a single channel downmix signal through consecutive TTO downmixing.

The bitstream generated in the second encoding unit 302 may be input to a USAC decoder 1306 of the first decoding unit 302. In FIG. 13, the USAC decoder 1306 included in the second encoding unit 302 may include a core decoding unit 1307, an SBR unit 1308, and an OTT box upmixing unit 1309.

The core decoding unit 1307 may output the mono signal of the core band corresponding to the low-frequency band using the bitstream. The SBR unit 1308 may copy the low-frequency band of the mono signal to reconstruct the high-frequency band. The upmixing unit 1309 may upmix the mono signal output from the SBR unit 1308 to generate a stereo signal forming M channel downmix signals.

OTT box upmixing units 1310 included in the second decoding unit 304 may upmix the mono signal included in the stereo signal generated by the first decoding unit 302 to generate a stereo signal.

According to the embodiment, an OTT upmixing process may be consecutively performed in order to recover N channel output signals from the bitstream. That is, the OTT box upmixing unit 1309 may upmix the mono signal (1 channel) to generate a stereo signal. Two mono signals forming the stereo signal output from the upmixing unit 1309 may be input to the OTT box upmixing units 1310. The OTT box upmixing units 1310 may upmix the input mono signals to output a stereo signal. That is, four channel output signals may be generated through consecutive OTT upmixing with respect to the mono signal.

Figure 14:
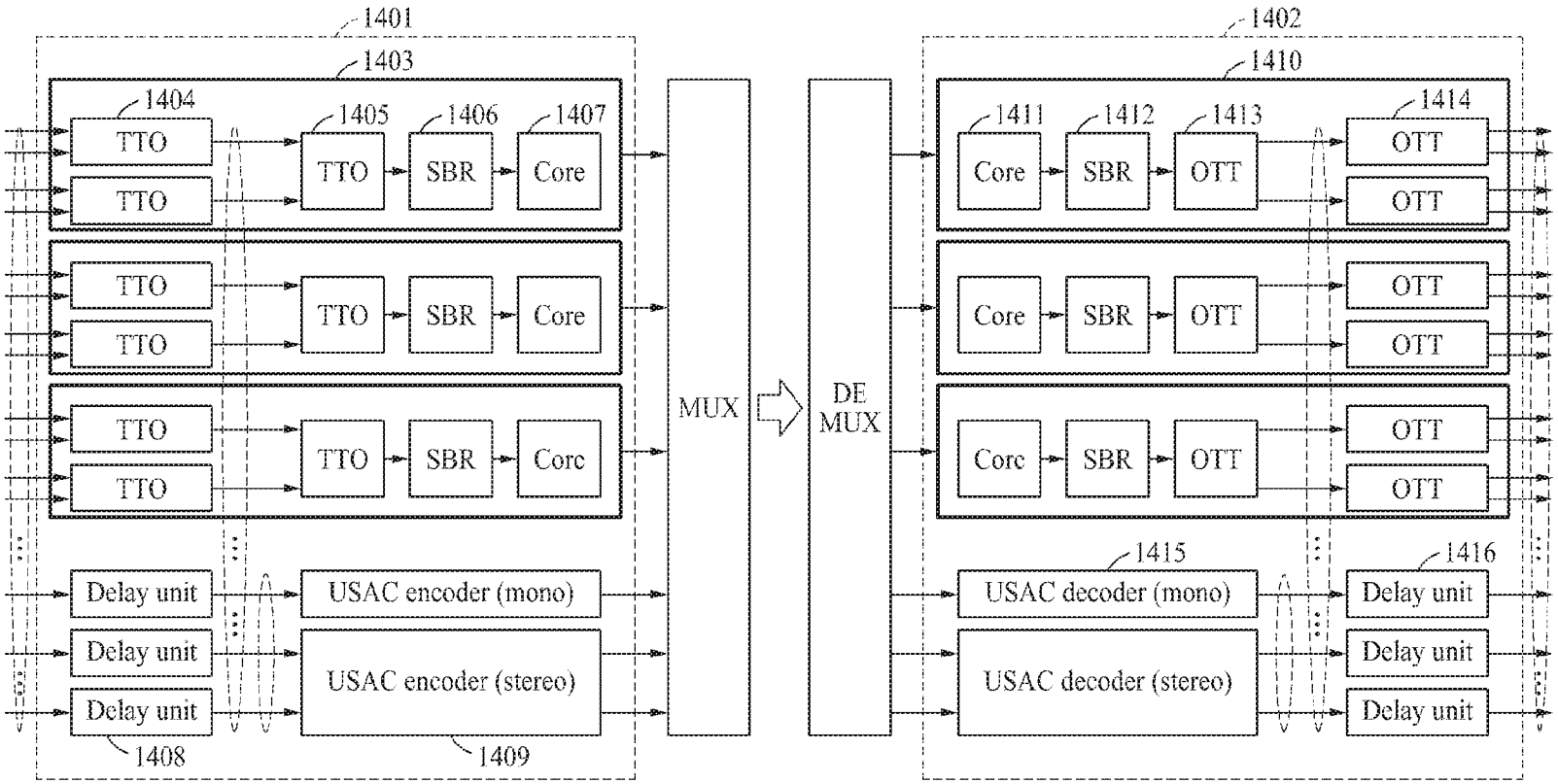
FIG. 14 illustrates a result of combining the first encoding unit and the second encoding unit of FIG. 11 and combining the first decoding unit and the second decoding unit of FIG. 11 according to an embodiment.

FIG. 14 illustrates a result of combining the first encoding unit and the second encoding unit of FIG. 11 and combining the first decoding unit and the second decoding unit of FIG. 11 according to an embodiment.

The first encoding unit and the second encoding unit of FIG. 11 may be combined into a single encoding unit 1401 as shown in FIG. 14. Also, the first decoding unit and the second decoding unit of FIG. 11 may be combined into a single decoding unit 1402 as shown in FIG. 14.

The encoding unit 1401 of FIG. 14 may include an encoding unit 1403 which includes a USAC encoder including a TTO box downmixing unit 1405, an SBR unit 1406 and a core encoding unit 1407 and further includes TTO box downmixing units 1404. Here, the encoding unit 1401 may include a plurality of encoding units 1403 disposed in parallel. Alternatively, the encoding unit 1403 may correspond to the USAC encoder including the TTO box downmixing units 1404.

That is, according to an embodiment, the encoding unit 1403 may consecutively apply TTO downmixing to four channel input signals among N channel input signals, thereby generating a single channel mono signal.

In the same manner, the decoding unit 1402 of FIG. 14 may include a decoding unit 1410 which includes a USAC decoder including a core decoding unit 1411, an SBR unit 1412, and an OTT box upmixing unit 1413, and further includes OTT box upmixing units 1414. Here, the decoding unit 1402 may include a plurality of decoding units 1410 disposed in parallel. Alternatively, the decoding unit 1410 may correspond to the USAC decoder including the OTT box upmixing units 1414.

That is, according to an embodiment, the decoding unit 1410 may consecutively apply OTT upmixing to a mono signal, thereby generating four channel signals among N channel output signals.

Figure 15:
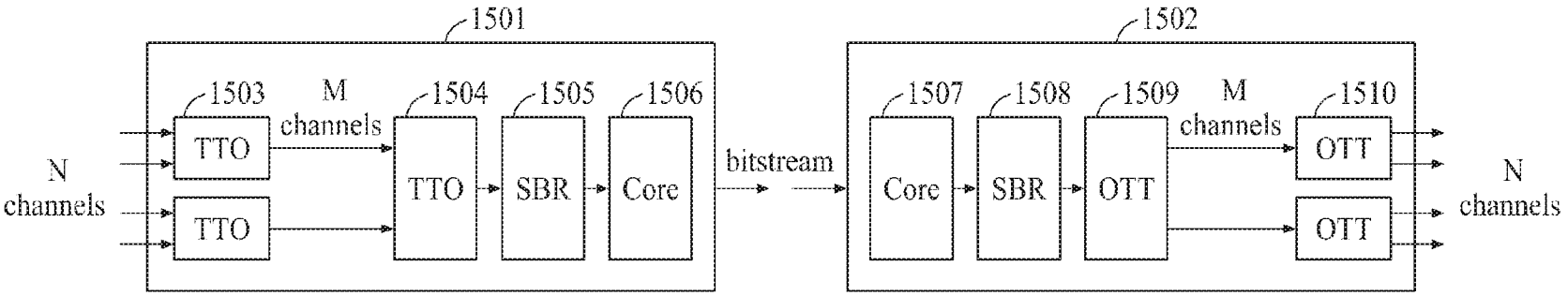
FIG. 15 simplifies FIG. 14 according to an embodiment.

FIG. 15 simplifies FIG. 14 according to an embodiment.

An encoding unit 1501 of FIG. 15 may correspond to the encoding unit 1403 of FIG. 14. Here, the encoding unit 1501 may correspond to a modified USAC encoder. That is, the modified USAC encoder may be configured by adding TTO box downmixing units 1503 to an original USAC encoder including a TTO box downmixing unit 1504, an SBR unit 1505, and a core encoding unit 1506.

A decoding unit 1502 of FIG. 15 may correspond to the decoding unit 1410 of FIG. 14. Here, the decoding unit 1502 may correspond to a modified USAC decoder. That is, the modified USAC decoder may be configured by adding OTT box upmixing units 1510 to an original USAC decoder including a core decoding unit 1507, an SBR unit 1508, and an OTT box upmixing unit 1509.

Figure 16:
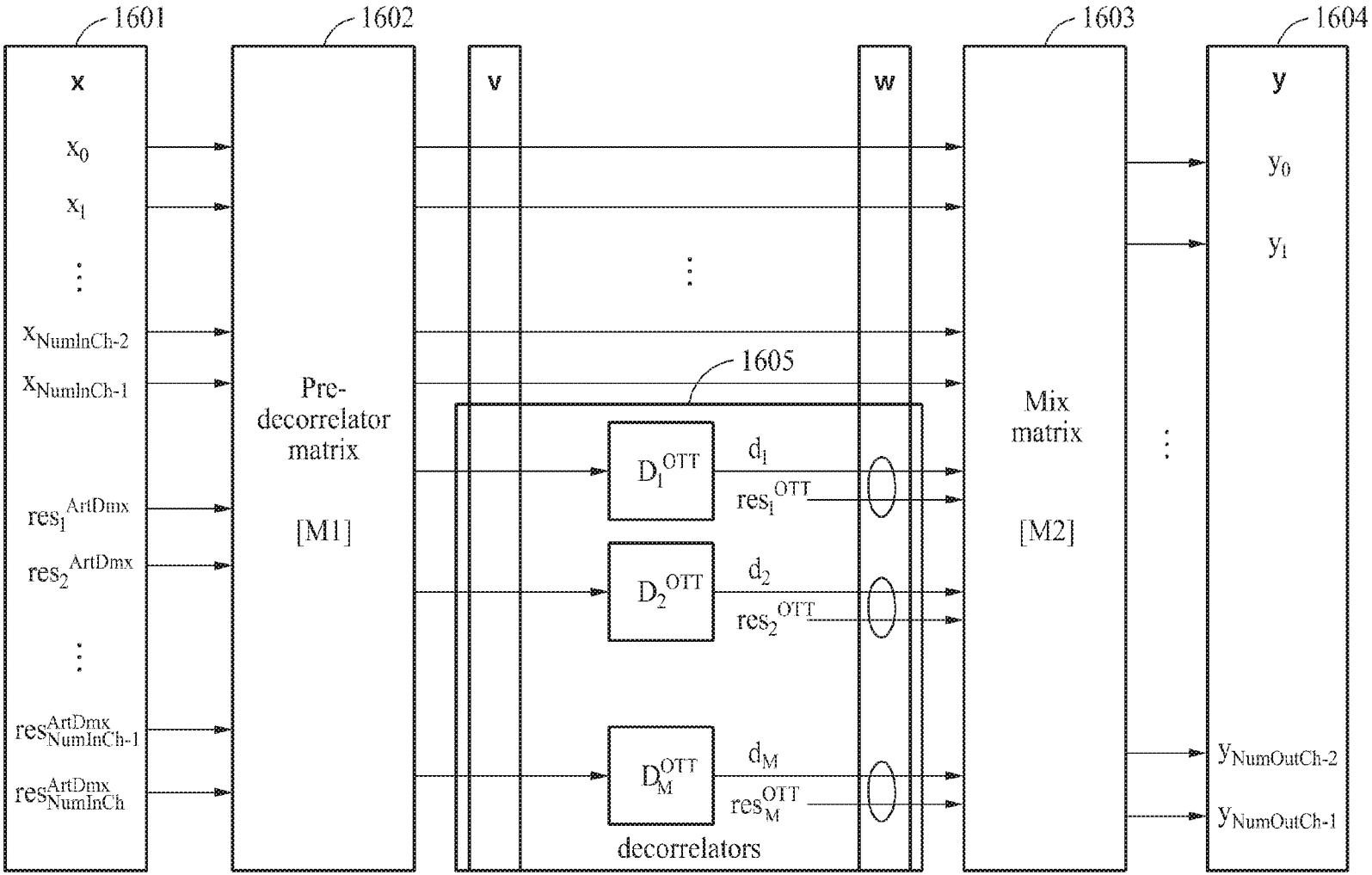
FIG. 16 is a diagram illustrating an audio processing method for an N-N/2-N structure according to an embodiment.

FIG. 16 is a diagram illustrating an audio processing method for an N-N/2-N structure according to an embodiment.

Figure 30:
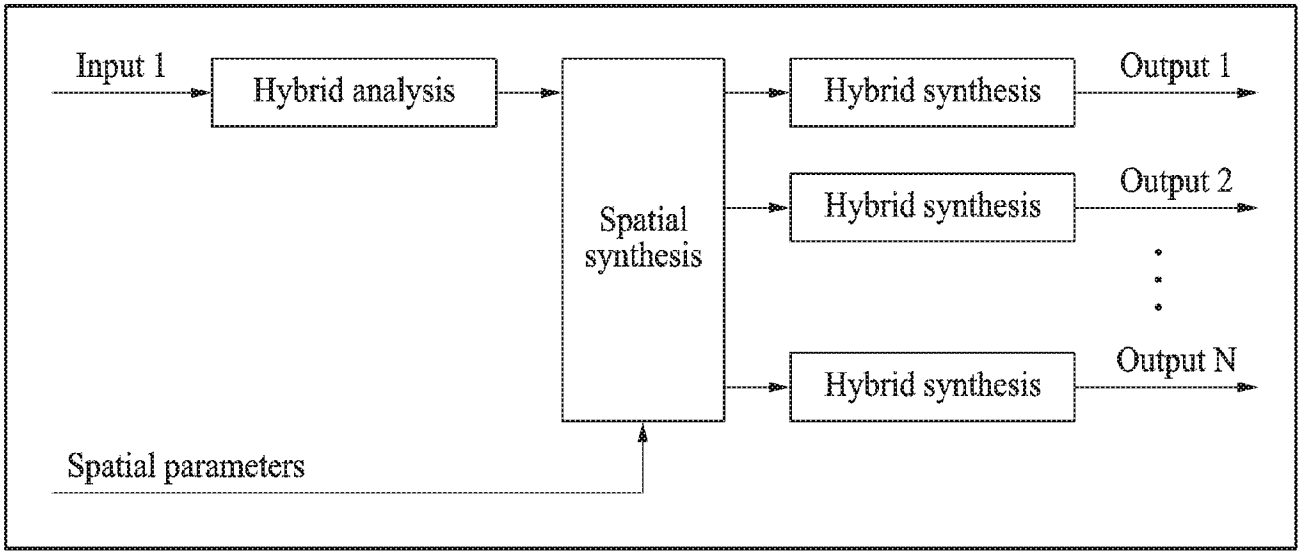
FIG. 30 is a diagram illustrating a decoder operated in a hybrid subband according to an embodiment.

FIG. 16 illustrates the N-N/2-N structure modified from a structure defined in MPEG Surround (MPS). Referring to FIG. 30, in the case of MPS, spatial synthesis may be performed at a decoder. The spatial synthesis may convert input signals from a time domain to a non-uniform subband domain through a Quadrature Mirror Filter (QMF) analysis bank. Here, the term "non-uniform" corresponds to a hybrid.

The decoder operates in a hybrid subband. The decoder may generate output signals from the input signals by performing the spatial synthesis based on spatial parameters transferred from an encoder. The decoder may inversely convert the output signals from the hybrid subband to the time domain using the hybrid QMF synthesis band.

A process of processing a multi-channel audio signal through a matrix mixed with the spatial synthesis performed by the decoder will be described with reference to FIG. 16. Basically, a 5-1-5 structure, a 5-2-5 structure, a 7-2-7 structure, and a 7-5-7 structure are defined in MPS, while the present disclosure proposes an N-N/2-N structure.

The N-N/2-N structure provides a process of converting N channel input signals to N/2 channel downmix signals and generating N channel output signals from the N/2 channel downmix signals. The decoder according to an embodiment may generate the N channel output signals by upmixing the N/2 channel downmix signals. Basically, there is no limit on the number of N channels in the N-N/2-N structure proposed herein. That is, the N-N/2-N structure may support a channel structure supported in MPS and a channel structure of a multi-channel audio signal not supported in MPS.

In FIG. 16, NumInCh denotes the number of downmix signal channels and NumOutCh denotes the number of output signal channels. Here, NumInCh is N/2 and NumOutCh is N.

In FIG. 16, N/2 channel downmix signals ($X_0$ through $X_{NumInch-1}$) and residual signals constitute an input vector X. Since NumInCh=N/2, $X_0$ through $X_{NumInCh-1}$ indicate N/2 channel downmix signals. Since the number of OTT boxes is N/2, the number of output signal channels for processing the N/2 channel downmix signals need to be even.

The input vector X to be multiplied by vector M corresponding to matrix M1 denotes a vector that includes N/2 channel downmix signals. When a Low Frequency Enhancement (LFE) channel is not included in N channel output signals, N/2 decorrelators may be maximally used. However, if the number N of output signal channels exceeds "20", filters of the decorrelators may be reused.

To guarantee the orthogonality between output signals of the decorrelators, if N=20, the number of available decorrelators is to be limited to a specific number, for example, 10. Accordingly, indices of some decorrelators may be repeated. According to an embodiment, in the N-N/2-N structure, the number N of output signal channels needs to be less than twice of the limited specific number (e.g., N<20). When the LFE channel is included in the N channel output signals, the number of N channels needs to be configured to be less than the number of channels corresponding to twice or more of the specific number into consideration of the number of LFE channels (e.g., N<24).

An output result of decorrelators may be replaced with a residual signal for a specific frequency domain based on a bitstream. When the LFE channel is one of outputs of OTT boxes, a decorrelator may not be used for an upmix-based OTT box.

In FIG. 16, decorrelators labeled from 1 to M (e.g., NumInCh through NumLfe), output results (decorrelated signals) of the decorrelators, and residual signal correspond to the respective different OTT boxes. $d_1$ through $d_M$ denote the decorrelated signals corresponding to the output of the decorrelators $D_1$ through $D_M$, and $res_1$~$res_M$ denote the residual signals corresponding to the output result of the decorrelators $D_1$ through $D_M$. The decorrelators $D_1$ through $D_M$ correspond to the different OTT boxes, respectively.

Hereinafter, a vector and a matrix used in the N-N/2-N structure will be defined. In the N−2/N-N structure, an input signal to be input to each of the decorrelators is defined as vector $v^{n,k}$.

The vector $v^{n,k}$ may be determined to be different depending on whether a temporal shaping tool is used or not as follows:

(1) In an example in which the temporal shaping tool is not used:

When the temporal shaping tool is not used, the vector $v^{n,k}$ is derived by vector $x^{n,k}$ and $M_1^{n,k}$ corresponding to the matrix M1 according to Equation 14. Here, $M_1^{n,k}$ denotes a matrix corresponding to an N-th raw and a first column.

[Equation 14]

$$v^{n,k} = M_1^{n,k} x^{n,k} = M_1^{n,k}\begin{bmatrix} x_{M_0}^{n,k} \\ x_{M_1}^{n,k} \\ \cdots \\ x_{M_{NumInCh-1}}^{n,k} \\ x_{res_0^{ArtDmx}}^{n,k} \\ x_{res_1^{ArtDmx}}^{n,k} \\ \cdots \\ x_{res_{NumInCh-1}^{ArtDmx}}^{n,k} \end{bmatrix} = \begin{bmatrix} v_{M_0}^{n,k} \\ v_{M_1}^{n,k} \\ \cdots \\ v_{M_{NumInCh-1}}^{n,k} \\ v_0^{n,k} \\ v_1^{n,k} \\ \cdots \\ v_{NumInCh-NumLfe-1}^{n,k} \end{bmatrix}$$

In Equation 14, among elements of the vector $v^{n,k}$, $v_{M_0}^{n,k}$ through $v_{M_{NumInCh-NumLfe-1}}^{n,k}$ may be directly input to matrix M2 instead of being input to N/2 decorrelators corresponding to N/2 OTT boxes. Accordingly, $v_{M_0}^{n,k}$ through $v_{M_{NumInCh-NumLfe-1}}^{n,k}$ may be defined as direct signals. The remaining signals $v_0^{n,k}$ through $v_{NumInCh-NumLfe-1}^{n,k}$ excluding $v_{M_0}^{n,k}$ through $v_{M_{NumInCh-NumLfe-1}}^{n,k}$ from among the elements of the vector $v^{n,k}$ may be input to the N/2 decorrelators corresponding to the N/2 OTT boxes.

The vector $w^{n,k}$ includes direct signals, the decorrelated signals $d_1$ through $d_M$ that are output from the decorrelators, and the residual signals $res_1$ through $res_M$ that are output from the decorrelators. The vector $w^{n,k}$ may be determined according to Equation 15.

[Equation 15]

$$w^{n,k} = \begin{bmatrix} v_{M_0}^{n,k} \\ v_{M_1}^{n,k} \\ \cdots \\ v_{M_{NumInCh-1}}^{n,k} \\ \delta_0(k)D_0\left(v_{M_0}^{n,k}\right) + (1 - \delta_0(k))v_{res_0}^{n,k} \\ \delta_1(k)D_1\left(v_{M_2}^{n,k}\right) + (1 - \delta_1(k))v_{res_1}^{n,k} \\ \cdots \\ \delta_{NumInCh-NumLfe-1}(k)D_{NumInCh-NumLfe-1}\left(v_{NumInCh-NumLfe-1}^{n,k}\right) + \\ (1 - \delta_{NumInCh-NumLfe-1}(k))v_{res_{NumInCh-NumLfe-1}}^{n,k} \end{bmatrix} = \begin{bmatrix} w_{M_0}^{n,k} \\ w_{M_1}^{n,k} \\ \cdots \\ w_{M_{NumInCh-1}}^{n,k} \\ w_1^{n,k} \\ w_2^{n,k} \\ \cdots \\ w_{NumInCh-NumLfe-1}^{n,k} \end{bmatrix}$$

In Equation 15, $$\delta_x(k) = \begin{cases} 0, & 0 \le k \le \max\{k_{set}\} \\ 1, & \text{otherwise} \end{cases}$$

and $k_{set}$ denotes a set of all K satisfying $\kappa(k)<m_{resProc}(X)$. Further, $D_X(v_X^{n,k})$ denotes a decorrelated signal output from a decorrelator $D_X$ when a signal $v_X^{n,k}$ is input to the decorrelator $D_X$. In particular, $D_X(v_X^{n,k})$ denotes a signal that is output from a decorrelator when an OTT box is OTTx and a residual signal is $v_{res_X}^{n,k}$.

A subband of an output signal may be defined to be dependent on all of time slots n and all of hybrid subbands k. The output signal $y^{n,k}$ may be determined based on the vector w and the matrix M2 according to Equation 16.

$$y^{n,k} = M_2^{n,k} w^{n,k} = M_2^{n,k} \begin{bmatrix} w_{M_0}^{n,k} \\ w_{M_1}^{n,k} \\ \cdots \\ w_{M_{NumInCh-1}}^{n,k} \\ w_1^{n,k} \\ w_2^{n,k} \\ \cdots \\ w_{NumInCh-NumLfe-1}^{n,k} \end{bmatrix} = \begin{bmatrix} y_0^{n,k} \\ y_1^{n,k} \\ \cdots \\ y_{NumInCh-2}^{n,k} \\ y_{NumInCh-1}^{n,k} \end{bmatrix} \quad \text{[Equation 16]}$$

In Equation 16, $M_2^{n,k}$ denotes the matrix M2 that includes a raw NumOutCh and a column NumInCh-NumLfe. $M_2^{n,k}$ may be defined with respect to $0 \le l < L$ and $0 \le k < K$, as expressed by Equation 17.

$$M_2^{n,k} = \begin{cases} W_2^{l,k}\alpha(n, l) + (1 - \alpha(n, l))W_2^{-1,k}, & 0 \le n \le t(l),\ l = 0 \\ W_2^{l,k}\alpha(n, l) + (1 - \alpha(n, l))W_2^{l-1,k}, & t(l-1) < n \le t(l),\ 1 \le l < L \end{cases} \quad \text{[Equation 17]}$$

In Equation 17, $$\alpha(n, l) = \begin{cases} \dfrac{n+1}{t(l)+1}, & l = 0 \\ \dfrac{n - t(l-1)}{t(l) - t(l-1)}, & \text{otherwise} \end{cases}.$$

$W_2^{l,k}$ may be smoothed according to Equation 18.

$$W_2^{l,k} = \begin{cases} s_{delta}(l) \cdot R_2^{l,\kappa(k)} + (1 - s_{delta}(l)) \cdot W_2^{l-1,k}, & S_{proc}(l, \kappa(k)) = 1 \\ R_2^{l,\kappa(k)}, & S_{proc}(l, \kappa(k)) = 0 \end{cases} \quad \text{[Equation 18]}$$

In Equation 18, κ(k) denotes a function of which a first row is a hybrid band k and of which a second row is a processing band, and $W_2^{-1,k}$ corresponds to a last parameter set of a previous frame.

Meanwhile, $y^{n,k}$ denote hybrid subband signals synthesizable to the time domain through a hybrid synthesis filter band. Here, the hybrid synthesis filter band is combined with a QMF synthesis bank through Nyquist synthesis banks, and $y^{n,k}$ may be converted from the hybrid subband domain to the time domain through the hybrid synthesis filter band.

(2) In an example in which the temporal shaping tool is used:

When the temporal shaping tool is used, the vector $v^{n,k}$ may be the same as described above, however, the vector $w^{n,k}$ may be classified into two types of vectors as expressed by Equation 19 and Equation 20.

$$w_{direct}^{n,k} = \begin{bmatrix} v_{M_0}^{n,k} \\ v_{M_1}^{n,k} \\ \cdots \\ v_{M_{NumInCh-1}}^{n,k} \\ (1\ \delta_0(k))v_{res_0}^{n,k} \\ (1 - \delta_0(k))v_{res_1}^{n,k} \\ \cdots \\ (1 - \delta_2(k))v_{res_{NumInCh-NumLfe-1}}^{n,k} \end{bmatrix} = \begin{bmatrix} w_{M_0}^{n,k} \\ w_{M_1}^{n,k} \\ \cdots \\ w_{M_{NumInCh-1}}^{n,k} \\ w_0^{n,k} \\ w_1^{n,k} \\ w_{NumInCh-NumLfe-1}^{n,k} \end{bmatrix} \quad \text{[Equation 19]}$$

-continued $$w_{diffuse}^{n,k} = \begin{bmatrix} v_{M_0}^{n,k} \\ v_{M_1}^{n,k} \\ \cdots \\ v_{M_{NumInCh-1}}^{n,k} \\ \delta_0(k)D_0(v_0^{n,k}) \\ \delta_0(k)D_1(v_1^{n,k}) \\ \cdots \\ \delta_{NumInCh-NumLfe-1}(k)D_{NumInCh-NumLfe-1}(v_{NumInCh-NumLfe-1}^{n,k}) \end{bmatrix} = \begin{bmatrix} w_{M_0}^{n,k} \\ w_{M_1}^{n,k} \\ \cdots \\ w_{M_{NumInCh-1}}^{n,k} \\ w_0^{n,k} \\ w_1^{n,k} \\ \cdots \\ w_{NumInCh-NumLfe-1}^{n,k} \end{bmatrix} \quad \text{[Equation 20]}$$

Here, $w_{direct}^{n,k}$ denotes a direct signal that is directly input to the matrix M2 without passing through a decorrelator and residual signals that are output from the decorrelators, and $w_{diffuse}^{n,k}$ denotes a decorrelated signal that is input from a decorrelator. Further, $$\delta_X(k) = \begin{cases} 0, & 0 \le k \le \max\{k_{set}\} \\ 1, & \text{otherwise} \end{cases},$$

and $k_{set}$ denotes a set of all k satisfying $\kappa(k)<m_{resProc}(X)$. In addition, $D_X(v_X^{n,k})$ denotes the decorrelated signal that is input from the decorrelator $D_X$ when the input signal $v_X^{n,k}$ is input to the decorrelator $D_X$.

Signals finally output by $w_{direct}^{n,k}$ and $w_{diffuse}^{n,k}$ defined in Equation 19 and Equation 20 may be classified into $y_{direct}^{n,k}$ and $y_{diffuse}^{n,k}$. $y_{direct}^{n,k}$ includes a direct signal and $y_{diffuse}^{n,k}$ includes a diffuse signal. That is, $y_{direct}^{n,k}$ is a result that is derived from the direct signal directly input to the matrix M2 without passing through a decorrelator and $y_{diffuse}^{n,k}$ is a result that is derived from the diffuse signal output from the decorrelator and input to the matrix M2.

In addition, $y_{direct}^{n,k}$ and $y_{diffuse}^{n,k}$ may be derived based on a case in which a Subband Domain Temporal Processing (STP) is applied to the N-N/2-N structure and a case in which Guided Envelope Shaping (GES) is applied to the N-N/2-N structure. In this instance, $y_{direct}^{n,k}$ and $y_{diffuse}^{n,k}$ are identified using bsTempShapeConfig that is a datastream element.

<Case in which STP is Applied>

To synthesize decorrelation levels between output signal channels, a diffuse signal is generated through a decorrelator for spatial synthesis. Here, the generated diffuse signal may be mixed with a direct signal. In general, a temporal envelope of the diffuse signal does not match an envelope of the direct signal.

In this instance, STP is applied to shape an envelope of a diffuse signal portion of each output signal to be matched to a temporal shape of a downmix signal transmitted from an encoder. Such processing may be achieved by calculating an envelope ratio between the direct signal and the diffuse signal or by estimating an envelope such as shaping an upper spectrum portion of the diffuse signal.

That is, temporal energy envelopes with respect to a portion corresponding to the direct signal and a portion corresponding to the diffuse signal may be estimated from the output signal generated through upmixing. A shaping factor may be calculated based on a ratio between the temporal energy envelopes with respect to the portion corresponding to the direct signal and the portion corresponding to the diffuse signal.

STP may be signaled to bsTempShapeConfig=1. If bsTempShapeEnableChannel(ch)=1, the diffuse signal portion of the output signal generated through upmixing may be processed through the STP.

Meanwhile, to reduce the necessity of a delay alignment of original downmix signals transmitted with respect to spatial upmixing for generating output signals, downmixing of spatial upmixing may be calculated as an approximation of the transmitted original downmix signal.

With respect to the N-N/2-N structure, a direct downmix signal for NumInCh-NumLfe may be defined as expressed by Equation 21.

$$z_{direct,d}^{n,sb} = \sum_{ch \in ch_d} z_{direct,ch}^{n,sb}, \quad \text{[Equation 21]}$$

$$0 \le d < (NumInCh - NumLfe)$$

In Equation 21, $ch_d$ includes a pair-wise output signal corresponding to a channel d of an output signal with respect to the N-N/2-N structure, and $ch_d$ may be defined with respect to the N-N/2-N structure, as expressed by Table 1.

TABLE 1

| Configuration | $ch_d$ |
|---|---|
| N-N/2-N | $\{ch_0, ch_1\}_{d=0}, \{ch_2, ch_3\}_{d=1}, \ldots, \{ch_{2d}, ch_{2d+1},\}_{d=NumInCh-NumLfe}$ |

Downmix broadband envelopes and an envelope with respect to a diffuse signal portion of each upmix channel may be estimated based on the normalized direct energy according to Equation 22.

$$E_{direct}^{n,sb} = |\hat{z}_{direct}^{n,sb} \cdot BP^{sb} \cdot GF^{sb}|^2 \quad \text{[Equation 22]}$$

In Equation 22, $BP^{sb}$ denotes a bandpass factor and $GF^{sb}$ denotes a spectral flattering factor.

In the N-N/2-N structure, since the direct signal for NumInCh-NumLfe is present, energy $E_{direct_norm,\ d}$ of the direct signal that satisfies 0≤d<(NumnCh−NumLfe) may be obtained using the same method as used in a 5-1-5 structure defined in the MPS. A scale factor associated with final envelope processing may be defined as expressed by Equation 23.

$$scale_{ch}^{n} = \sqrt{\frac{E_{direct_norm,d}^{n}}{E_{diffuse_norm,ch}^{n} + \varepsilon}}, \quad \text{[Equation 23]}$$

$$ch \in \{ch_{2d}, ch_{2d+1}\}_d$$

In Equation 23, the scale factor may be defined if ≤d< (NumInCh−NumLfe) is satisfied with respect to the N-N/2-N structure. By applying the scale factor to the diffuse signal portion of the output signal, the temporal envelope of the output signal may be substantially mapped to the temporal envelope of the downmix signal. Accordingly, the diffuse signal portion processed using the scale factor in each of channels of the N channel output signals may be mixed with the direct signal portion. Through this process, whether the diffuse signal portion is processed using the scale factor may be signaled for each of output signal channels. If bsTempShapeEnableChannel(ch)=1, it indicates that the diffuse signal portion is processed using the scale factor.

<Case in which GES is Applied>

In the case of performing temporal shaping on the diffuse signal portion of the output signal, a characteristic distortion is likely to occur. Accordingly, GES may enhance temporal/spatial quality by outperforming the distortion issue. The decoder may individually process the direct signal portion and the diffuse signal portion of the output signal. In this instance, if GES is applied, only the direct signal portion of the upmixed output signal may be altered.

GES may recover a broadband envelope of a synthesized output signal. GES includes a modified upmixing process after flattening and reshaping an envelope with respect to a direct signal portion for each of output signal channels.

Additional information of a parametric broadband envelope included in a bitstream may be used for reshaping. The additional information includes an envelope ratio between an envelope of an original input signal and an envelope of a downmix signal. The decoder may apply the envelope ratio to a direct signal portion of each of time slots included in a frame for each of output signal channels. Due to GES, a diffuse signal portion for each output signal channel is not altered.

If bsTempShapeConfig=2, a GES process may be performed. If GES is available, each of a diffuse signal and a direct signal of an output signal may be synthesized using post mixing matrix M2 modified in a hybrid subband domain according to Equation 24.

$$y_{direct}^{n,k}=M_2^{n,k}w_{direct}^{n,k}\ y_{diffuse}^{n,k}=M_2^{n,k}w_{diffuse}^{n,k}\ \text{for}\ 0\le k<K\ \text{and}\ 0\le n<\text{numSlots} \quad \text{[Equation 24]}$$

In Equation 24, a direct signal portion for an output signal y provides a direct signal and a residual signal, and a diffuse signal portion for the output signal y provides a diffuse signal. Overall, only the direct signal may be processed using GES.

A GES processing result may be determined according to Equation 25.

$$y_{ges}^{n,k}=y_{direct}^{n,k}+y_{diffuse}^{n,k} \quad \text{[Equation 25]}$$

GES may extract an envelope with respect to a downmix signal for performing spatial synthesis aside from an LFE channel depending on a tree structure and a specific channel of an output signal upmixed from the downmix signal by the decoder.

In the N-N/2-N structure, an output signal $ch_{output}$ may be defined as expressed by Table 2.

TABLE 2

| Configuration | $ch_{output}$ |
|---|---|
| N-N/2-N | $0 \le ch_{out} < 2(\text{NumInCh} - \text{NumLfe})$ |

In the N-N/2-N structure, an input signal $ch_{input}$ may be defined as expressed by Table 3.

TABLE 3

| Configuration | $ch_{input}$ |
|---|---|
| N-N/2-N | $0 \le ch_{input} < (\text{NumInCh} - \text{NumLfe})$ |

Also, in the N-N/2-N structure, a downmix signal Dch ($ch_{output}$) may be defined as expressed by Table 4.

TABLE 4

| Configuration | bsTreeConfig | Dch($ch_{ouput}$) |
|---|---|---|
| N-N/2-N | 7 | Dch($ch_{ouput}$) = d, if $ch_{ouput} \in \{ch_{2d}, ch_{2d+1}\}_d$ with: $0 \le d < (\text{NumInCh} - \text{NumLfe})$ |

Hereinafter, the matrix M1 ($M_1^{n,k}$) and the matrix M2 (M2) defined with respect to all of time slots n and all of hybrid subbands k will be described. The matrices are interpolated versions of $R_1^{l,m}G_1^{l,m}H^{l,m}$ and $R_2^{l,m}$ defined with respect to a given parameter time slot 1 and a given processing band m based on CLD, ICC, and CPC parameters valid for a parameter time slot and a processing band.

<Definition of Matrix M1 (Pre-Matrix)>

A process of inputting a downmix signal to decorrelators used at the decoder in the N−N/2-N structure of FIG. 16 will be described using $M_1^{n,k}$ corresponding to the matrix M1. The matrix M1 may be expressed as a pre-matrix.

A size of the matrix M1 depends on the number of channels of downmix signals input to the matrix M1 and the number of decorrelators used at the decoder. Here, elements of the matrix M1 may be derived from CLD and/or CPC parameters. The matrix M1 may be defined as expressed by Equation 26.

$$M_1^{n,k}=\begin{cases} W_1^{l,k}\alpha(n,l)+(1-\alpha(n,l))W_1^{-1,k}, & 0\le n\le t(l),\ l=0 \\ W_1^{l,k}\alpha(n,l)+(1-\alpha(n,l))W_1^{l-1,k}, & t(l-1)<n\le t(l),\ 1\le l<L \end{cases} \quad \text{[Equation 26]}$$

$$\text{for } 0\le l<L,\ 0\le k<K$$

In Equation 26, $$\alpha(n,l)=\begin{cases} \dfrac{n+1}{t(l)+1}, & l=0 \\ \dfrac{n-t(l-1)}{t(l)-t(l-1)}, & \text{otherwise} \end{cases}.$$

Meanwhile, $W_1^{l,k}$ may be smoothed according to Equation 27.

$$W_1^{l,k} = \begin{cases} s_{delta}(l) \cdot W_{konj}^{l,k} + (1 - s_{delta}(l)) \cdot W_1^{l-1,k} & S_{proc}(l, \kappa(k)) = 1 \\ W_{konj}^{l,k} & S_{proc}(l, \kappa(k)) = 0 \end{cases}$$

$$W_{temp}^{l,k} = R_1^{l,\kappa(k)} G_1^{l,\kappa(k)} H^{l,\kappa,(k)}$$

$$W_{konj}^{l,k} = \kappa_{konj}(k, W_{temp}^{l,k})$$

$$\text{for } 0 \le k < K, 0 \le l < L$$

[Equation 27]

In Equation 27, in each of κ(k) and $\kappa_{konj}$(k,x), a first row is a hybrid subband k, a second row is a processing band, and a third row is a complex conjugation x* of x with respect to a specific hybrid subband k. Further, $W_1^{-1,k}$ denotes a last parameter set of a previous frame.

Matrices $R_1^{l,m}$ $G_1^{l,m}$, and $H^{l,m}$ for the matrix M1 may be defined as follows:

(1) Matrix R1:

Matrix $R_1^{l,m}$ may control the number of signals to be input to decorrelators, and may be expressed as a function of CLD and CPS since a decorrelated signal is not added.

The matrix $R_1^{l,m}$ may be differently defined based on a channel structure. In the N–N/2-N structure, all of channels of input signals may be input in pairs to an OTT box to prevent OTT boxes from being cascaded. In the N-N/2-N structure, the number of OTT boxes is N/2.

In this case, the matrix $R_1^{l,m}$ depends on the number of OTT boxes equal to a column size of the vector $x^{n,k}$ that includes an input signal. However, LFE upmix based on an OTT box does not require a decorrelator and thus, is not considered in the N-N/2-N structure. All of elements of the matrix $R_1^{l,m}$ may be either 1 or 0.

In the N-N/2-N structure, the matrix $R^1$ may be defined as expressed by Equation 28.

$$R_1^{l,m} = \left[\frac{I_{NumInCh}}{I_{NumInCh-NumLfe}}\right], 0 \le m < M_{proc}, 0 \le l \le L$$

[Equation 28]

In the N-N/2-N structure, all of the OTT boxes represent parallel processing stages instead of cascade. Accordingly, in the N-N/2-N structure, none of the OTT boxes are connected to other OTT boxes. The matrix R1 may be configured using unit matrix $I_{NumInCh}$ and unit matrix $I_{NumInCh\text{-}NumLfe}$. Here, unit matrix $I_N$ may be a unit matrix with the size of N*N.

(2) Matrix GI:

To handle a downmix signal or a downmix signal supplied from an outside prior to MPS decoding, a datastream controlled based on correction factors may be applicable. A correction factor may be applicable to the downmix signal or the downmix signal supplied from the outside, based on matrix $G_1^{l,m}$.

The matrix $G_1^{l,m}$ may guarantee that a level of a downmix signal for a specific time/frequency tile represented by a parameter is equal to a level of a downmix signal obtained when an encoder estimates a spatial parameter.

It can be classified into three cases; (i) a case in which external downmix compensation is absent (bsArbitrary-Downmix=0), (ii) a case in which parameterized external downmix compensation is present (bsArbitraryDown-mix=1), and (iii) residual coding based on external downmix compensation is performed. If bsArbitraryDownmix=1, the decoder does not support the residual coding based on the external downmix compensation.

If the external downmix compensation is not applied in the N-N/2-N structure bsArbitraryDownmix=0), the matrix $G_1^{l,m}$ in the N-N/2-N structure may be defined as expressed by Equation 29.

$$G_1^{l,m} = [I_{NumInCh} | O_{NumInCh}]$$

[Equation 29]

In Equation 29, $I_{NumInch}$ denotes a unit matrix that indicates a size of NumInCh*NumInCh and $O_{NumInCh}$ denotes a zero matrix that indicates a size of NumInCh*NumInCh.

On the contrary, if the external downmix compensation is applied in the N-N/2-N structure (bsArbitraryDownmix=1), the matrix $G_1^{l,m}$ in the N-N/2-N structure may be defined as expressed by Equation 30:

$$G_1^{l,m} = \left[\underbrace{\begin{matrix} g_0^{l,m} & 0 & \cdots & 0 & 0 \\ 0 & g_1^{l,m} & 0 & \cdots & 0 \\ \vdots & 0 & \ddots & 0 & \vdots \\ 0 & \cdots & 0 & g_{NumInCh-2}^{l,m} & 0 \\ 0 & 0 & \cdots & 0 & g_{NumInCh-1}^{l,m} \end{matrix}}_{NumInCh \times NumInCh} \quad O_{NumInCh}\right]$$

[Equation 30]

In Equation 30, $g_X^{l,m}$=G(X,l,m), 0≤X<NumInCh, 0≤m<$M_{proc}$, 0≤l<L.

Meanwhile, if residual coding based on the external downmix compensation is applied in the N-N/2-N structure (bsArbitraryDownmix=2), the matrix $G_1^{l,m}$ may be defined as expressed by Equation 31:

$$G_1^{l,m} = \begin{cases} \begin{bmatrix} \alpha \cdot g_0^{l,m} & 0 & \cdots & 0 & 0 \\ 0 & \alpha \cdot g_1^{l,m} & 0 & \cdots & 0 \\ \vdots & 0 & \ddots & 0 & \vdots \\ 0 & \cdots & 0 & \alpha \cdot g_{NumInCh-2}^{l,m} & 0 \\ 0 & 0 & \cdots & 0 & \alpha \cdot g_{NumInCh-1}^{l,m} \end{bmatrix}_{NumInCh \times NumInCh} I_{NumInCh}, & m \le m_{ArtDmxRes}(i) \\ \begin{bmatrix} g_0^{l,m} & 0 & \cdots & 0 & 0 \\ 0 & g_1^{l,m} & 0 & \cdots & 0 \\ \vdots & 0 & \ddots & 0 & \vdots \\ 0 & \cdots & 0 & g_{NumInCh-2}^{l,m} & 0 \\ 0 & 0 & \cdots & 0 & g_{NumInCh-1}^{l,m} \end{bmatrix}_{NumInCh \times NumInCh} O_{NumInCh}, & \text{otherwise} \end{cases}$$

[Equation 31]

In Equation 31, $g_X^{l,m}=G(X,l,m)$, $0 \le X < NumInCh$, $0 \le m < M_{proc}$, $0 \le l < L$, $\alpha$ may be updated.

(3) Matrix H1:

In the N-N/2-N structure, the number of downmix signal channels may be five or more. Accordingly, inverse matrix H may be a unit matrix having a size corresponding to the number of columns of vector $x^{n,k}$ of an input signal with respect to all of parameter sets and processing bands.

<Definition of Matrix M2 (Post-Matrix)>

In the N-N/2-N structure, $M_2^{n,k}$ that is the matrix M2 defines a combination between a direct signal and a decorrelated signal in order to generate a multi-channel output signal. $M_2^{n,k}$ may be defined as expressed by Equation 32:

$$M_2^{n,k} = \begin{cases} W_2^{l,k}\alpha(n,l) + (1-\alpha(n,l))W_2^{-1,k}, & 0 \le n \le t(l),\ l = 0 \\ W_2^{l,k}\alpha(n,l) + (1-\alpha(n,l))W_2^{l-1,k}, & t(l-1) < n \le t(l),\ 1 \le l < L \end{cases}$$

for $0 \le l < L$, $0 \le k < K$

[Equation 32]

In Equation 32, $$\alpha(n,l) = \begin{cases} \dfrac{n+1}{t(l)+1}, & l = 0 \\ \dfrac{n-t(l-1)}{t(l)-t(l-1)}, & \text{otherwise} \end{cases}.$$

Meanwhile, $W_2^{l,k}$ may be smoothed according to Equation 33.

$$W_2^{l,k} = \begin{cases} s_{delta}(l) \cdot R_2^{l,\kappa(k)} + (1 - s_{delta}(l)) \cdot W_2^{l-1,k}, & S_{proc}(l,\kappa(k)) = 1 \\ R_2^{l,\kappa(k)}, & S_{proc}(l,\kappa(k)) = 0 \end{cases}$$

[Equation 33]

In Equation 33, in each of $\kappa(k)$ and $\downarrow_{konj}(k,x)$, a first row is a hybrid subband k, a second row is a processing band, and a third row is a complex conjugation x* of x with respect to a specific hybrid subband k. Further, $W_2^{-1,k}$ denotes a last parameter set of a previous frame.

An element of the matrix $R_2^{n,k}$ for the matrix M2 may be calculated from an equivalent model of an OTT box. The OTT box includes a decorrelator and a mixing unit. A mono input signal input to the OTT box may be transferred to each of the decorrelator and the mixing unit. The mixing unit may generate a stereo output signal based on the mono input signal, a decorrelated signal output through the decorrelator, and CLD and ICC parameters. Here, CLD controls localization in a stereo field and ICC controls a stereo wideness of an output signal.

A result output from an arbitrary OTT box may be defined as expressed by Equation 34.

$$\begin{bmatrix} y_0^{l,m} \\ y_1^{l,m} \end{bmatrix} = H \begin{bmatrix} x^{l,m} \\ q^{l,m} \end{bmatrix} = \begin{bmatrix} H11_{OTT_X}^{l,m} & H12_{OTT_X}^{l,m} \\ H21_{OTT_X}^{l,m} & H22_{OTT_X}^{l,m} \end{bmatrix} \begin{bmatrix} x^{l,m} \\ q^{l,m} \end{bmatrix}$$

[Equation 34]

The OTT box may be labeled with $OTT_X$ where $0 \le X < numOttBoxes$, and $H11_{OTT_x}^{l,m} \ldots H22_{OTT_x}^{l,m}$ denotes an element of the arbitrary matrix in a time slot l and a parameter band m with respect to the OTT box.

Here, a post gain matrix may be defined as expressed by Equation 35.

$$\begin{bmatrix} H11_{OTT_X}^{l,m} & H12_{OTT_X}^{l,m} \\ H21_{OTT_X}^{l,m} & H22_{OTT_X}^{l,m} \end{bmatrix} = \begin{cases} \begin{bmatrix} c_{1,X}^{l,m}\cos(\alpha_X^{l,m}+\beta_X^{l,m}) & 1 \\ c_{2,X}^{l,m}\cos(-\alpha_X^{l,m}+\beta_X^{l,m}) & -1 \end{bmatrix}, & m < resBands_X \\ \begin{bmatrix} c_{1,X}^{l,m}\cos(\alpha_X^{l,m}+\beta_X^{l,m}) & c_{1,X}^{l,m}\sin(\alpha_X^{l,m}+\beta_X^{l,m}) \\ c_{2,X}^{l,m}\cos(-\alpha_X^{l,m}+\beta_X^{l,m}) & c_{2,X}^{l,m}\sin(-\alpha_X^{l,m}+\beta_X^{l,m}) \end{bmatrix}, & \text{otherwise} \end{cases} \quad \text{[Equation 35]}$$

In Equation 35, $$c_{1,X}^{l,m} = \sqrt{\frac{10^{\frac{CLD_X^{l,m}}{10}}}{1+10^{\frac{CLD_X^{l,m}}{10}}}},\ c_{2,X}^{l,m} = \sqrt{\frac{1}{1+10^{\frac{CLD_X^{l,m}}{10}}}},$$

$$\beta_X^{l,m} = \arctan\left(\tan(\alpha_X^{l,m})\frac{c_{2,X}^{l,m}-c_{1,X}^{l,m}}{c_{2,X}^{l,m}+c_{1,X}^{l,m}}\right), \text{ and}$$

$$\alpha_X^{l,m} = \frac{1}{2}\arccos(\rho_X^{l,m}).$$

Meanwhile, $$\rho_X^{l,m} = \begin{cases} \max\left\{ICC_X^{l,m}, \lambda_0\left(10^{\frac{CLD_X^{l,m}}{20}}+10^{\frac{-CLD_X^{l,m}}{20}}\right)\right\}, & m < resBands_X \\ ICC_X^{l,m}, & \text{otherwise} \end{cases}$$

where $\lambda_0=-11/72$ for $0 \le m < M_{proc}$, $0 \le l < L$.

Further, $$resBands_X = \begin{cases} m_{resProc}(X), & bsResidualPresent(X)=1,\ bsResidualCoding=1 \\ 0, & \text{otherwise,} \end{cases}.$$

Here, in the N-N/2-N structure, $R_2^{l,m}$ may be defined as expressed by Equation 36.

$$R_2^{l,m} = \begin{bmatrix} \begin{bmatrix} H11_{OTT_0}^{l,m}(n) & H12_{OTT_0}^{l,m}(n) \\ H21_{OTT_0}^{l,m}(n) & H22_{OTT_0}^{l,m}(n) \end{bmatrix} & O_2 & \cdots & O_2 \\ O_2 & \ddots & & \\ \vdots & & \begin{bmatrix} H11_{OTT_i}^{l,m} & H12_{OTT_i}^{l,m} \\ H21_{OTT_i}^{l,m} & H22_{OTT_i}^{l,m} \end{bmatrix} & \vdots \\ & & \ddots & O_2 \\ O_2 & & \cdots & O_2 \begin{bmatrix} H11_{OTT_{numOttBoxes-1}}^{l,m}(n) & H12_{OTT_{numOttBoxes-1}}^{l,m}(n) \\ H21_{OTT_{numOttBoxes-1}}^{l,m}(n) & H22_{OTT_{numOttBoxes-1}}^{l,m}(n) \end{bmatrix} \end{bmatrix} \quad \text{[Equation 36]}$$

In Equation 36, CLD and ICC may be defined as expressed by Equation 37.

$$CLD_X^{l,m}=D_{CLD}(X,l,m)$$

$$ICC_X^{l,m}=D_{ICC}(X,l,m) \quad \text{[Equation 37]}$$

In Equation 37, $0 \le X < NumInCh$, $0 \le m < M_{proc}$, $0 \le l < L$.

<Definition of Decorrelator>

In the N-N/2-N structure, decorrelators may be performed by reverberation filters in a QMF subband domain. The reverberation filters may represent different filter characteristics based on a current corresponding hybrid subband among all of hybrid subbands.

A reverberation filter refers to an imaging infrared (IIR) lattice filter. IIR lattice filters have different filter coefficients with respect to different decorrelators in order to generate mutually decorrelated orthogonal signals.

A decorrelation process performed by a decorrelator may proceed through a plurality of processes. Initially, $v^{n,k}$ that is an output of the matrix M1 is input to a set of an all-pass decorrelation filter. Filtered signals may be energy-shaped. Here, energy shaping indicates shaping a spectral or temporal envelope so that decorrelated signals may be matched to be further closer to input signals.

Input signal $v_X^{n,k}$ input to an arbitrary decorrelator is a portion of the vector $v^{n,k}$. To guarantee orthogonality between decorrelated signals derived through a plurality of decorrelators, the plurality of decorrelators has different filter coefficients.

Due to constant frequency-dependent delay, a decorrelator filter includes a plurality of all-pass IIR areas. A frequency axis may be divided into different areas to correspond to QMF divisional frequencies. For each area, a length of delay and lengths of filter coefficient vectors are same. A filter coefficient of a decorrelator having fractional delay due to additional phase rotation depends on a hybrid subband index.

As described above, filters of decorrelators have different filter coefficients to guarantee the orthogonality between decorrelated signals that are output from the decorrelators. In the N–N/2-N structure, N/2 decorrelators are required. Here, in the N-N/2-N structure, the number of decorrelators may be limited to 10. In the N-N/2-N structure in which an LFE mode is absent, if the number, N/2, of OTT boxes exceeds "10", decorrelators may be reused in correspondence to the number of OTT boxes exceeding "10", according to a 10-basis modulo operation.

Table 5 shows an index of a decorrelator in the decoder of the N-N/2-N structure. Referring to Table 5, indices of N/2 decorrelators are repeated based on a unit of "10". That is, a zero-th decorrelator and a tenth decorrelator have the same index of DOTT

TABLE 5

| | Decorrelator $^{X=0,\ldots,rem(N/2-1,10)}$ | | | | | | | | |
|---|---|---|---|---|---|---|---|---|---|
| configurati | 0 | 1 | 2 | . . . | 9 | 10 | 11 | . . . | N/2 − 1 |
| N-N/2-N | $D_0^{OTT}$ ( ) | $D_1^{OTT}$ ( ) | $D_2^{OTT}$ ( ) | . . . | $D_9^{OTT}$ ( ) | $D_0^{OTT}$ ( ) | $D_1^{OTT}$ ( ) | . . . | $D_{mod(N/2-1,10)}^{OTT}$ ( ) |

The N-N/2-N structure may be configured based on syntax as expressed by Table 6.

TABLE 6

| Syntax | No. of bits | Mnemonic |
|---|---|---|
| SpatialSpecificConfig( ) | | |
| { | | |
| bsSamplingFrequencyIndex; | 4 | uimsbf |
| if ( bsSamplingFrequencyIndex == 0xf ) { | | |
| bsSamplingFrequency; | 24 | uimsbf |
| } | | |
| bsFrameLength; | 7 | uimsbf |
| bsFreqRes; | 3 | uimsbf |
| bsTreeConfig; | 4 | uimsbf |
| if (bsTreeConfig == '0111') { | | |
| bsNumInCh; | 4 | uimsbf |
| bsNumLFE | 2 | uimsbf |
| bsHasSpeakerConfig | 1 | uimsbf |
| if ( bsHasSpeakerConfig == 1) { | | |
| audioChannelLayout = SpeakerConfig3d( ); | | Note 1 |
| } | | |
| } | | |
| bsQuantMode; | 2 | uimsbf |
| bsOneIcc; | 1 | uimsbf |
| bsArbitraryDownmix; | 1 | uimsbf |
| bsFixedGainSur; | 3 | uimsbf |
| bsFixedGainLFE; | 3 | uimsbf |
| bsFixedGainDMX; | 3 | uimsbf |
| bsMatrixMode; | 1 | uimsbf |
| bsTempShapeConfig; | 2 | uimsbf |
| bsDecorrConfig; | 2 | uimsbf |
| bs3DaudioMode; | 1 | uimsbf |
| if ( bsTreeConfig == '0111' ) { | | |
| for (i=0; i< NumInCh - NumLfe; i++) { | | |
| defaultCld[i] = 1; | | |
| ottModelfe[i] = 0; | | |
| } | | |
| for (i= NumInCh - NumLfe; i< NumInCh; i++) { | | |
| defaultCld[i] = 1; | | |
| ottModelfe[i] = 1; | | |
| } | | |
| } | | |
| for (i=0; i<numOttBoxes; i++) { | | Note 2 |
| OttConfig(i); | | |
| } | | |
| for (i=0; i<numTttBoxes; i++) { | | Note 2 |
| TttConfig(i); | | |
| } | | |
| if (bsTempShapeConfig == 2) { | | |
| bsEnvQuantMode | 1 | uimsbf |
| } | | |
| if (bs3DaudioMode) { | | |
| bs3DaudioHRTFset; | 2 | uimsbf |
| if (bs3DaudioHRTFset==0) { | | |
| ParamHRTFset( ); | | |
| } | | |
| } | | |
| ByteAlign( ); | | |
| SpatialExtensionConfig( ); | | |
| } | | |

Note 1:
SpeakerConfig3d( ) is defined in ISO/IEC 23008-3:2015, Table 5.
Note 2:
numOttBoxes and numTttBoxes are defined by Table 9.2 dependent on bsTreeConfig.

Here, bsTreeConfig may be expressed by Table 7

TABLE 7

| bsTreeConfig | Meaning |
|---|---|
| 0,1,2,3,4,5,6 | Identical meaning of Table 40 in ISO/IEC 20003-1:2007 |
| 7 | N-N/2-N configuration<br>numOttBoxes = NumInCh<br>numTttBoxes = 0<br>numInChan = NumInCh<br>numOutChan = NumOutCh<br>output channel ordering is according to Table 9.5 |
| 8 . . . 15 | Reserved |

In the N-N/2-N structure, the number, bsNumInCh, of downmix signal channels may be expressed by Table 8.

TABLE 8

| bsNumInCh | NumInCh | NumOutCh |
|---|---|---|
| 0 | 12 | 24 |
| 1 | 7 | 14 |
| 2 | 5 | 10 |
| 3 | 6 | 12 |
| 4 | 8 | 16 |
| 5 | 9 | 18 |
| 6 | 10 | 20 |
| 7 | 11 | 22 |
| 8 | 13 | 26 |
| 9 | 14 | 28 |
| 10 | 15 | 30 |
| 11 | 16 | 32 |
| 12, . . . , 15 | Reserved | Reserved |

the N-N/2-N structure, the number, $N_{LFE}$, of LFE channels among output signals may be expressed by Table 9.

TABLE 9

| bsNumLFE | NumLfe |
|---|---|
| 0 | 0 |
| 1 | 1 |
| 2 | 2 |
| 3 | Reserved |

In the N-N/2-N structure, channel ordering of output signals may be performed based on the number of output signal channels and the number of LFE channels as expressed by Table 10.

TABLE 10

| NumOutCh | NumLfe | Output channel ordering |
|---|---|---|
| 24 | 2 | Rv, Rb, Lv, Lb, Rs, Rvr, Lsr, Lvr, Rss, Rvss, Lss, Lvss, Rc, R, Lc, L, Ts, Cs, Cb, Cvr, C, LFE, Cv, LFE2, |
| 14 | 0 | L, Ls, R, Rs, Lbs, Lvs, Rbs, Rvs, Lv, Rv, Cv, Ts, C, LFE |
| 12 | 1 | L, Lv, R, Rv, Lsr, Lvr, Rsr, Rvr, Lss, Rss, C, LFE |

TABLE 10-continued

| NumOutCh | NumLfe | Output channel ordering |
|---|---|---|
| 12 | 2 | L, Lv, R, Rv, Ls, Lss, Rs, Rss, C, LFE, Cvr, LFE2 |
| 10 | 1 | L, Lv, R, Rv, Lsr, Lvr, Rsr, Rvr, C, LFE |

Note 1:
All of Names and layouts of loudspeaker is following the naming and position of Table 8 in ISO/IEC 23001-8: 2013/FDAM1.
Note 2:
Output channel ordering for the case of 16, 20, 22, 26, 30, 32 is following the arbitrary order from 1 to N without any specific naming of speaker layouts.
Note 3:
Output channel ordering for the case when bsHasSpeakerConfig == 1 is following the order from 1 to N with associated naming of speaker layouts as specified in Table 94 of ISO/IEC 23008-3: 2015.

In Table 6, bsHasSpeakerConfig denotes a flag indicating whether a layout of an output signal to be played is different from a layout corresponding to channel ordering in Table 10. If bsHasSpeakerConfig==1, audioChannelLayout that is a layout of a loudspeaker for actual play may be used for rendering.

In addition, audioChannelLayout denotes the layout of the loudspeaker for actual play. If the loudspeaker includes an LFE channel, the LFE channel is to be processed together with things being not the LFE channel using a single OTT box and may be located at a last position in a channel list. For example, the LFE channel is located at a last position among L, Lv, R, Rv, Ls, Lss, Rs, Rss, C, LFE, Cvr, and LFE2 that are included in the channel list.

Figure 17:
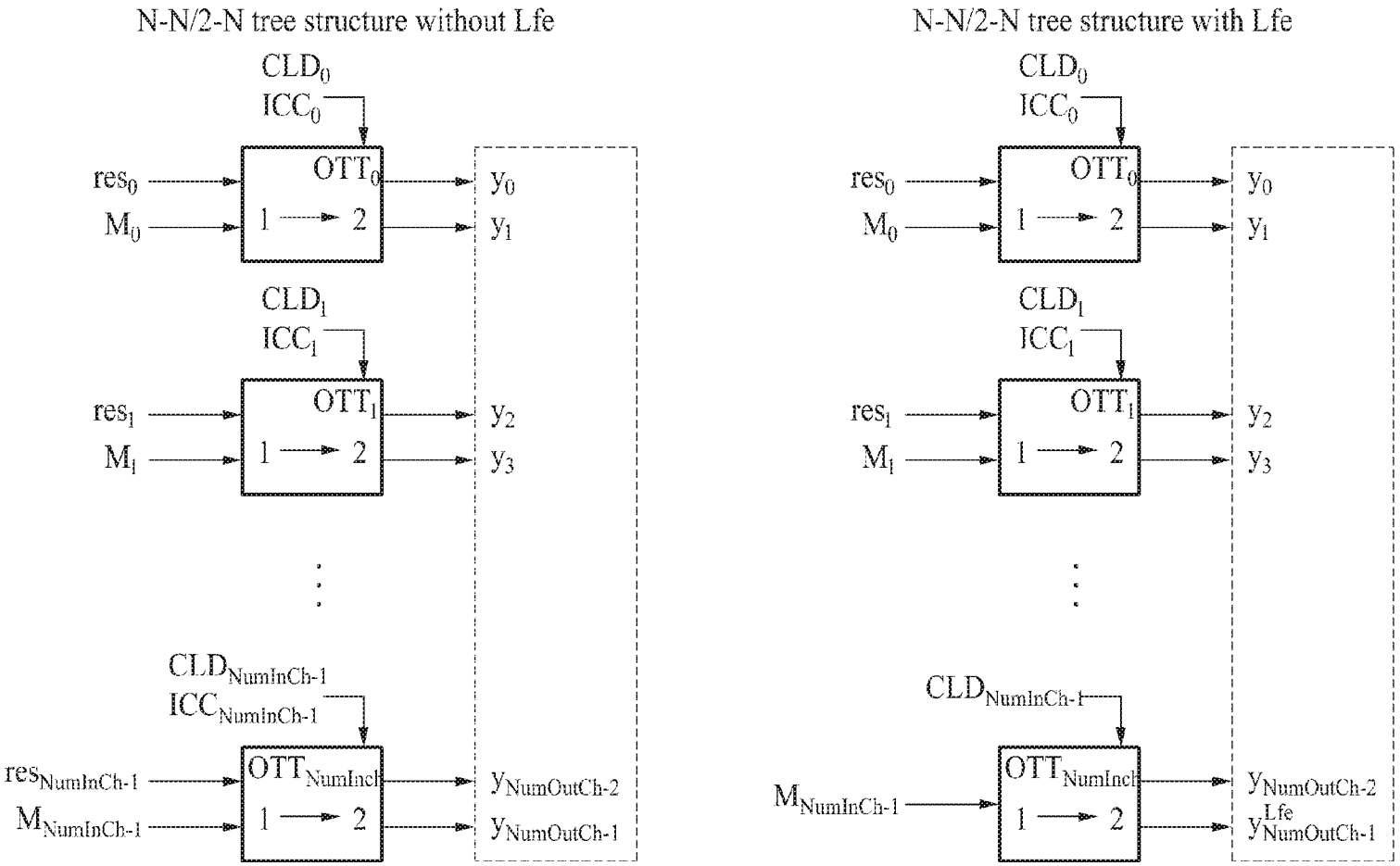
FIG. 17 is a diagram illustrating an N-N/2-N structure in a tree structure according to an embodiment.

FIG. 17 is a diagram illustrating an N-N/2-N structure in a tree structure according to an embodiment.

The N-N/2-N structure of FIG. 16 may be expressed in the tree structure of FIG. 17. In FIG. 17, all of the OTT boxes may regenerate two channel output signals based on CLD, ICC, a residual signal, and an input signal. An OTT box and CLD, ICC, a residual signal, and an input signal corresponding thereto may be numbered based on order indicated in a bitstream.

Referring to FIG. 17, N/2 OTT boxes are present. Here, a decoder that is a multi-channel audio signal processing apparatus may generate N channel output signals from N/2 channel downmix signals using the N/2 OTT boxes. Here, the N/2 OTT boxes are not configured through a plurality of hierarchs. That is, the OTT boxes may perform parallel upmixing for each of channels of the N/2 channel downmix signals. That is, one OTT box is not connected to another OTT box.

Meanwhile, a left side of FIG. 17 illustrates a case in which an LFE channel is not included in N channel output signals and a right side of FIG. 17 illustrates a case in which the LFE channel is included in the N channel output signals.

When the LFE channel is not included in the N channel output signals, the N/2 OTT boxes may generate N channel output signals using residual signals (res) and downmix signals (M). However, when the LFE channel is not included in the N channel output signals, an OTT box that outputs the LFE channel among the N/2 OTT boxes may use only a downmix signal aside from a residual signal.

In addition, when the LFE channel is included in the N channel output signals, an OTT box that does not output the LFE channel among the N/2 OTT boxes may upmix a downmix signal using CLD and ICC and an OTT box that does not output the LFE channel may upmix a downmix signal using only CLD.

When the LFE channel is included in the N channel output signals, an OTT box that does not output the LFE channel among the N/2 OTT boxes generates a decorrelated signal through a decorrelator and an OTT box that outputs the LFE channel does not perform a decorrelation process and thus, does not generate a decorrelated signal.

Figure 18:
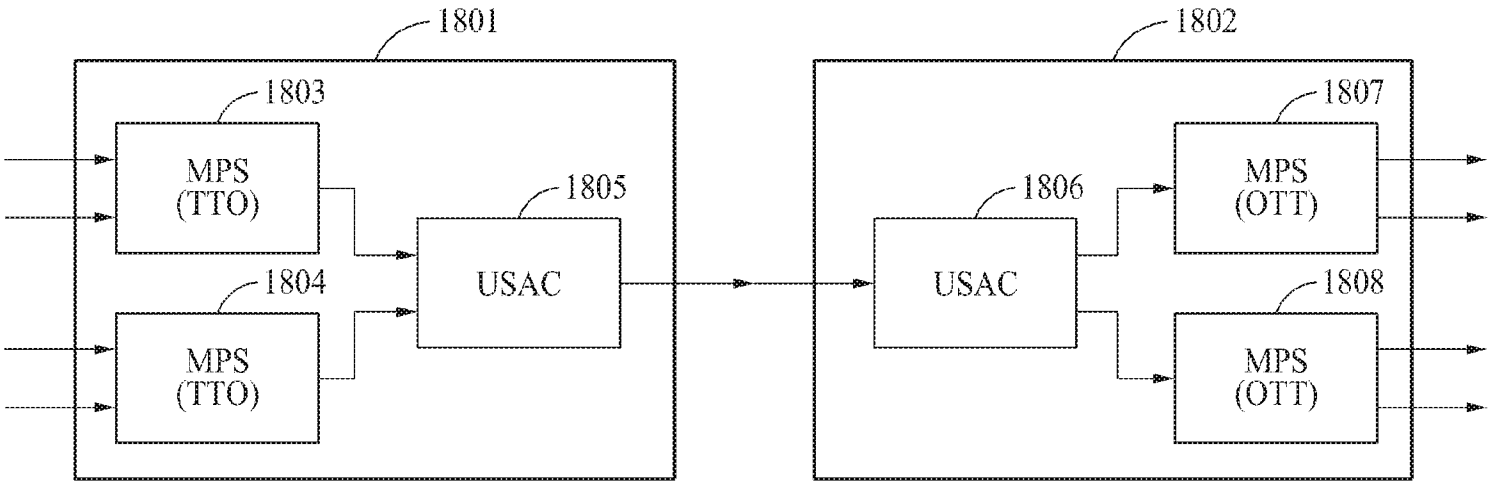
FIG. 18 is a diagram illustrating an encoder and a decoder for a Four Channel Element (FCE) structure according to an embodiment.

FIG. 18 is a diagram illustrating an encoder and a decoder for a Four Channel Element (FCE) structure according to an embodiment.

Referring to FIG. 18, an FCE corresponds to an apparatus that generates a single channel output signal by downmixing four channel input signals or generates four channel output signals by upmixing a single channel input signal.

An FCE encoder 1801 may generate a single channel output signal from four channel output signals using two TTO boxes 1803 and 1804 and a USAC encoder 1805.

The TTO boxes 1803 and 1804 may generate a single channel downmix signal from four channel output signals by each downmixing two channel input signals. The USC encoder 1805 may perform encoding in a core band of a downmix signal.

An FCE decoder 1802 inversely performs an operation performed by the FCE encoder 1801. The FCE decoder 1802 may generate four channel output signals from a single channel input signal using a USAC decoder 1806 and two OTT boxes 1807 and 1808. The OTT boxes 1807 and 1808 may generate four channel output signals by each upmixing a single channel input signal decoded by the USAC decoder 1806. The USC decoder 1806 may perform encoding in a core band of an FCE downmix signal.

The FCE decoder 1802 may perform coding at a relatively low bitrate to operate in a parametric mode using spatial cues such as CLD, IPD, and ICC. A parametric type may be changed based on at least one of an operating bitrate and a total number of input signal channels, a resolution of a parameter, and a quantization level. The FCE encoder 1801 and the FCE decoder 1802 may be widely used for bitrates of 128 kbps through 48 kbps.

The number of output signal channels of the FCE decoder 1802 is "4", which is the same as the number of input signal channels of the FCE encoder 1801.

Figure 19:
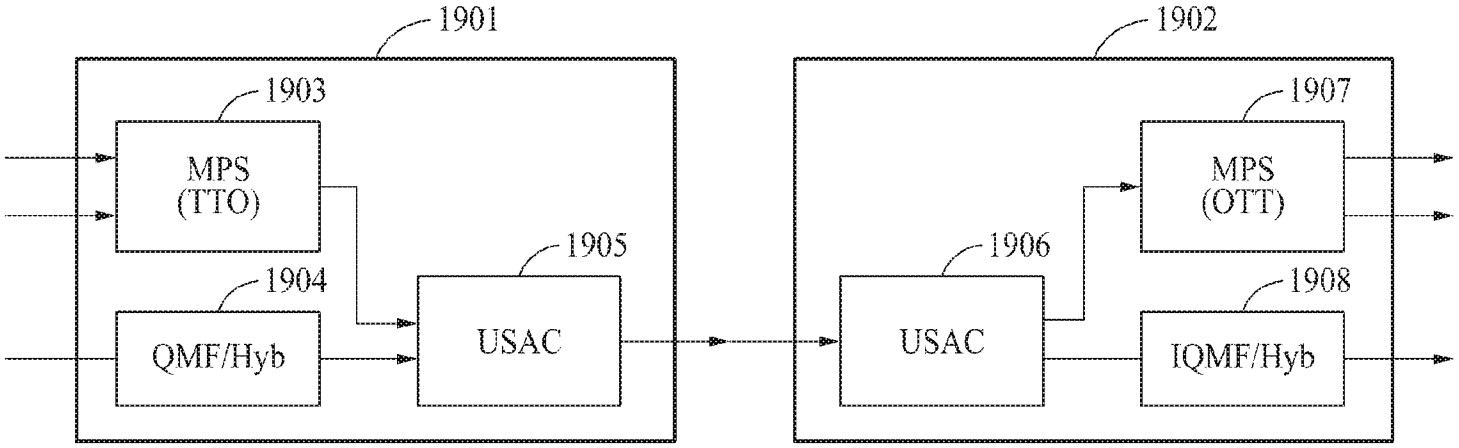
FIG. 19 is a diagram illustrating an encoder and a decoder for a Three Channel Element (TCE) structure according to an embodiment.

FIG. 19 is a diagram illustrating an encoder and a decoder for a Three Channel Element (TCE) structure according to an embodiment.

Referring to FIG. 19, a TCE corresponds to an apparatus that generates a single channel output signal from three channel input signals or generates three channel output signals from a single channel input signal.

A TCE encoder 1901 may include a single TTO box 1903, a single QMF converter 1904, and a single USAC encoder 1905. Here, the QMF converter 1904 may include a hybrid analyzer/synthesizer. Two channel input signals may be input to the TTO box 1903 and a single channel input signal may be input to the QMF converter 1904. The TTO box 1903 may generate a single channel downmix signal by downmixing the two channel input signals. The QMF converter 1904 may convert the single channel input signal to a QMF domain.

An output result of the TTO box 1903 and an output result of the QMF converter 1904 may be input to the USAC encoder 1905. The USAC encoder 1905 may encode a core band of two channel signals input as the output result of the TTO box 1903 and the output result of the QMF converter 1904.

Referring to FIG. 19, since the number of input signal channels is "3" corresponding to an odd number, only two channel input signals may be input to the TTO box 1903 and a remaining single channel input signal may pass by the TTO box 1903 and be input to the USAC encoder 1905. In this instance, since the TTO box 1903 operates in a parametric mode, the TCE encoder 1901 may be generally applicable when the number of input signal channels is 11.1 or 9.0.

A TCE decoder 1902 may include a single USAC decoder 1906, a single OTT box 1907, and a single QMF inverse-converter 1904. A single channel input signal input from the TCE encoder 1901 is decoded at the USAC decoder 1906. Here, the USAC decoder 1906 may perform decoding with respect to a core band in a single channel input signal.

Two channel input signals output from the USAC decoder 1906 may be input to the OTT box 1907 and the QMF inverse-converter 1908, respectively, for the respective channels. The QMF inverse-converter 1908 may include a hybrid analyzer/synthesizer. The OTT box 1907 may generate two channel output signals by upmixing a single channel input signal. The QMF inverse-converter 1908 may inversely convert a remaining single channel input signal between two channel input signals output through the USAC decoder 1906 to be from a QMF domain to a time domain or a frequency domain.

The number of output signal channels of the TCE decoder 1902 is "3", which is the same as the number of input signal channels of the TCE encoder 1901.

Figure 20:
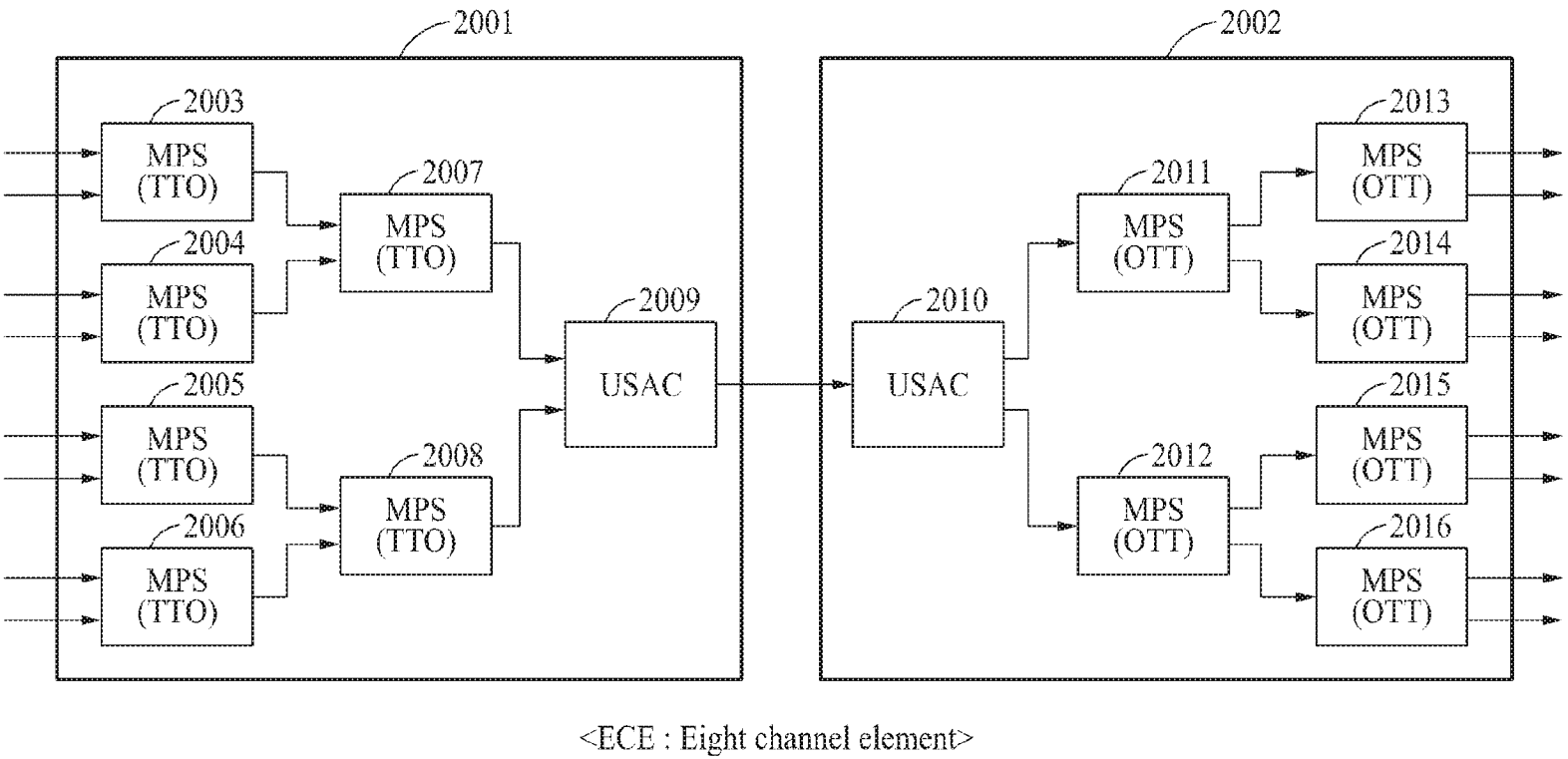
FIG. 20 is a diagram illustrating an encoder and a decoder for an Eight Channel Element (ECE) structure according to an embodiment.

FIG. 20 is a diagram illustrating an encoder and a decoder for an Eight Channel Element (ECE) structure according to an embodiment.

Referring to FIG. 20, an ECE corresponds to an apparatus that generates a single channel output signal by downmixing eight channel input signals or generates eight channel output signals by upmixing a single channel input signal.

An ECE encoder 2001 may generate a single channel output signal from input signals of eight channels using six TTO boxes 2003, 2004, 2005, 2006, 2007, and 2008, and a USAC encoder 2009. Eight channel input signals are input in pairs as a 2-channel input signal to four TTO boxes 2003, 2004, 2005, and 2006, respectively. In this case, each of the four TTO boxes 2003, 2004, 2005, and 2006 may generate a single channel output signal by downmixing two channel input signals. An output result of the four TTO boxes 2003, 2004, 2005, and 2006 may be input to two TTO boxes 2007 and 2008 that are connected to the four TTO box 2003, 2004, 2005, and 2006.

The two TTO boxes 2007 and 2008 may generate a single channel output signal by each downmixing two channel output signals among output signals of the four TTO boxes 2003, 2004, 2005, and 2006. In this case, an output result of the two TTO boxes 2007 and 2008 may be input to the USAC encoder 2009 connected to the two TTO boxes 2007 and 2008. The USAC encoder 2009 may generate a single channel output signal by encoding two channel input signals.

Accordingly, the ECE encoder 2001 may generate a single channel output signal from eight channel input signals using TTO boxes that connected in a 2-stage tree structure. That is, the four TTO boxes 2003, 2004, 2005, and 2006, and the two TTO boxes 2007 and 2008 may be mutually connected in a cascaded form and thereby configure a 2-stage tree. When a channel structure of an input signal is 22.2 or 14.0, the ECE encoder 2001 may be used for a bitrate of 48 kbps or 64 kbps.

The ECE decoder 2002 may generate eight channel output signals from a single channel input signal using six OTT boxes 2011, 2012, 2013, 2014, 2015, and 2016 and a USAC decoder 2010. Initially, a single channel input signal generated by the ECE encoder 2001 may be input to the USAC decoder 2010 included in the ECE decoder 2002. The USAC decoder 2010 may generate two channel output signals by decoding a core band of the single channel input signal. The two channel output signals output from the USAC decoder 2010 may be input to the OTT boxes 2011 and 2012, respectively, for the respective channels. The OTT box 2011 may generate two channel output signals by upmixing a single channel input signal. Similarly, the OTT box 2012 may generate two channel output signals by upmixing a single channel input signal.

An output result of the OTT boxes 2011 and 2012 may be input to each of the OTT boxes 2013, 2014, 2015, and 2016 that are connected to the OTT boxes 2011 and 2012. Each of the OTT boxes 2013, 2014, 2015, and 2016 may receive and upmix a single channel output signal between two channel output signals corresponding to the output result of the OTT boxes 2011 and 2012. That is, each of the OTT boxes 2013, 2014, 2015, and 2016 may generate two channel output signals by upmixing a single channel input signal. The number of output signal channels obtained from the four OTT boxes 2013, 2014, 2015, and 2016 is 8.

Accordingly, the ECE decoder 2002 may generate eight channel output signals from a single channel input signal using OTT boxes that are connected in a 2-stage tree structure. That is, the four OTT boxes 2013, 2014, 2015, and 2016 and the two OTT boxes 2011 and 2012 may be mutually connected in a cascaded form and thereby configure a 2-stage tree.

The number of output signal channels of the ECE decoder 2002 is as "8", which is the same as the number of input signal channels of the ECE encoder 2001.

Figure 21:
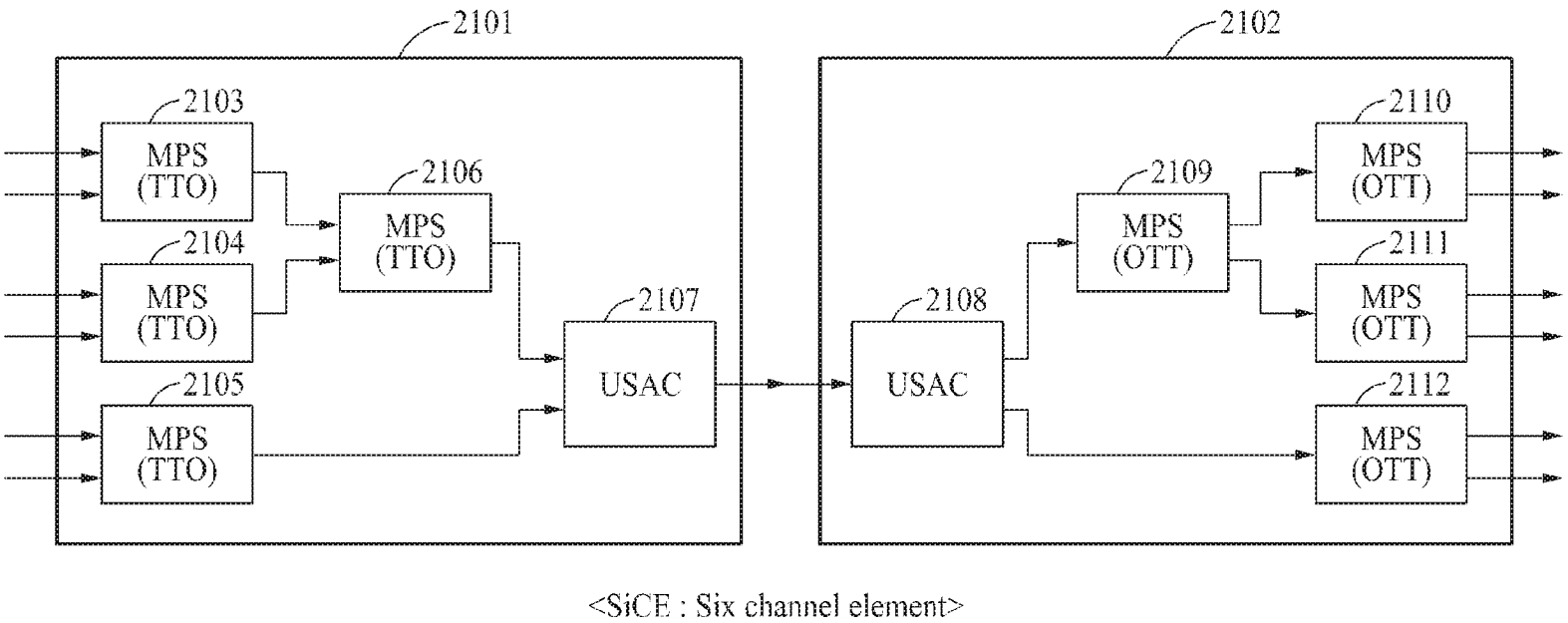
FIG. 21 is a diagram illustrating an encoder and a decoder for a Six Channel Element (SiCE) structure according to an embodiment.

FIG. 21 is a diagram illustrating an encoder and a decoder for a Six Channel Element (SiCE) structure according to an embodiment.

Referring to FIG. 21, an SiCE corresponds to an apparatus that generates a single channel output signal from six channel input signals or generates six channel output signals from a single channel input signal.

An SiCE encoder 2101 may include four TTO boxes 2103, 2104, 2105, and 2106, and a single USAC encoder 2107. Here, six channel input signals may be input to three TTO boxes 2103, 2104, and 2106. Each of the three TTO boxes 2103, 2104, and 2105 may generate a single channel output signal by downmixing two channel input signals among six channel input signals. Two TTO boxes among three TTO boxes 2103, 2104, and 2105 may be connected to another TTO box. In FIG. 21, the TTO boxes 2103 and 2104 may be connected to the TTO box 2106.

An output result of the TTO boxes 2103 and 2104 may be input to the TTO box 2106. Referring to FIG. 21, the TTO box 2106 may generate a single channel output signal by downmixing two channel input signals. Meanwhile, an output result of the TTO box 2105 is not input to the TTO box 2106. That is, the output result of the TTO box 2105 passes by the TTO box 2106 and is input to the USAC encoder 2107.

The USAC encoder 2107 may generate a single channel output signal by encoding a core band of two channel input signals corresponding to the output result of the TTO box 2105 and the output result of the TTO box 2106.

In the SiCE encoder 2101, three TTO boxes 2103, 2104, and 2105 and a single TTO box 2106 configure different stages. Dissimilar to the ECE encoder 2001, in the SiCE encoder 2101, two TTO boxes 2103 and 2104 among three TTO boxes 2103, 2103, and 2105 are connected to a single TTO box 2106 and a remaining single TTO box 2105 passes by the TTO box 2106. The SiCE encoder 2101 may process an input signal in a 14.0 channel structure at a bitrate of 48 kbps and/or 64 kbps.

An SiCE decoder 2102 may include a single USAC decoder 2108 and four OTT boxes 2109, 2110, 2111, and 2112.

A single channel output signal generated by the SiCE encoder 2101 may be input to the SiCE decoder 2102. The USAC decoder 2108 of the SiCE decoder 2102 may generate two channel output signals by decoding a core band of the single channel input signal. A single channel output signal between two channel output signals generated from the USAC decoder 2108 is input to the OTT box 2109 and a single channel output signal passes by the OTT box 2109 is directly input to the OTT box 2112.

The OTT box 2109 may generate two channel output signals by upmixing a single channel input signal transferred from the USAC decoder 2108. A single channel output signal between two channel output signals generated from the OTT box 2109 may be input to the OTT box 2110 and a remaining single channel output signal may be input to the OTT box 2111. Each of the OTT boxes 2110, 2111, and 2112 may generate two channel output signals by upmixing a single channel input signal.

Each of the encoders of FIGS. 18 through 21 in the FCE structure, the TCE structure, the ECE structure, and the SiCE structure may generate a single channel output signal from N channel input signals using a plurality of TTO boxes. Here, a single TTO box may be present even in a USAC encoder that is included in each of the encoders in the FCE structure, the TCE structure, ECE structure, and the SiCE structure.

Meanwhile, each of the encoders in the ECE structure and the SiCE structure may be configured using 2-stage TTO boxes. Further, when the number of input signal channels, such as in the TCE structure and the SiCE structure, is an odd number, a TTO box being passed by may be present.

Each of the decoders in the FCE structure, the TCE structure, the ECE structure, and the SiCE structure may generate N channel output signals from a single channel input signal using a plurality of OTT boxes. Here, a single OTT box may be present even in a USAC decoder that is included in each of the decoders in the FCE structure, the TCE structure, the ECE structure, and the SiCE structure.

Meanwhile, each of the decoders in the ECE structure and the SiCE structure may be configured using 2-stage OTT boxes. Further, when the number of input signal channels, such as in the TCE structure and the SiCE structure, is an odd number, an OTT box being passed by may be present.

Figure 22:
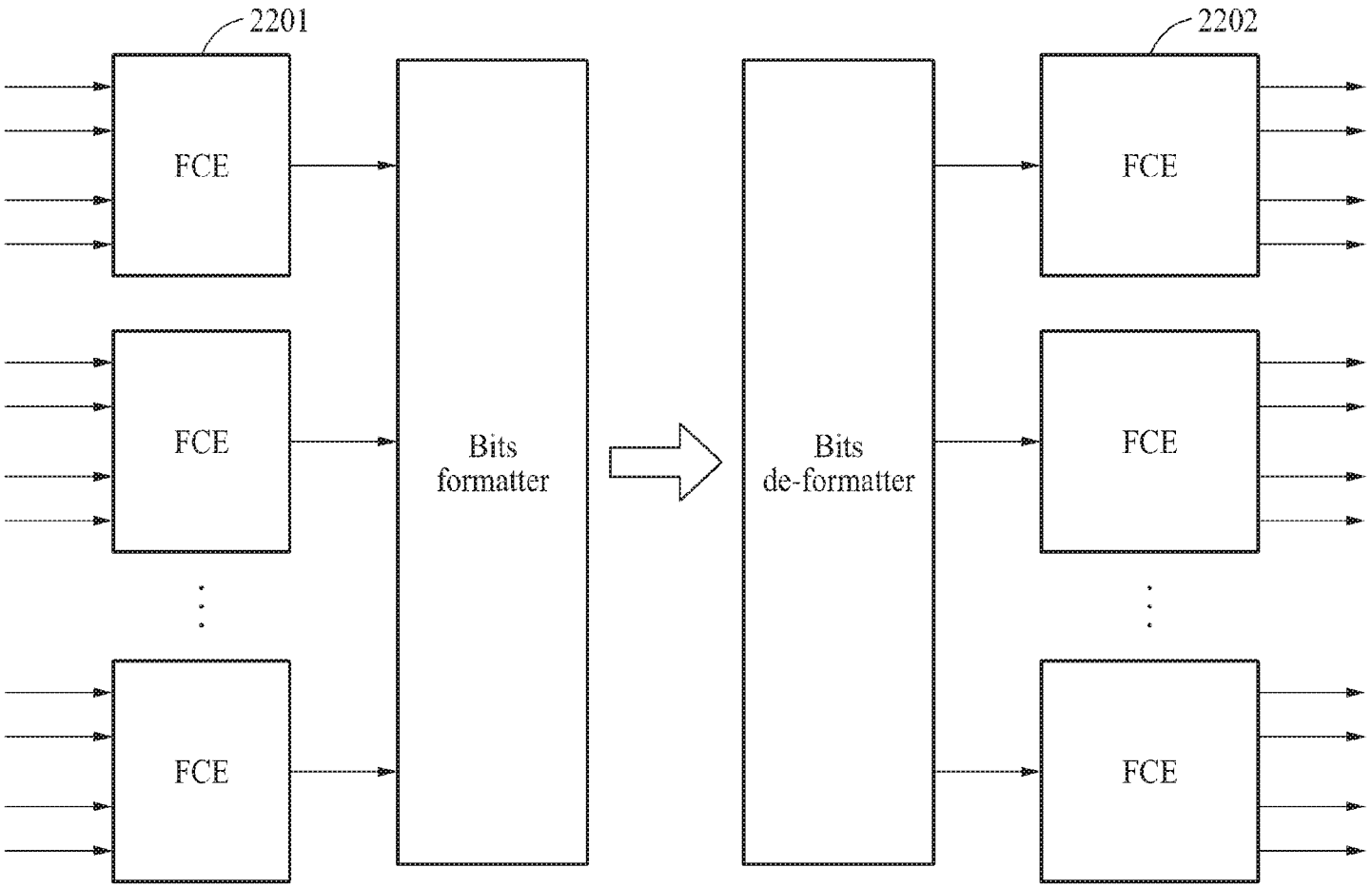
FIG. 22 is a diagram illustrating a process of processing 24 channel audio signals based on an FCE structure according to an embodiment.

FIG. 22 is a diagram illustrating a process of processing 24 channel audio signals based on an FCE structure according to an embodiment.

In detail, FIG. 22 illustrates a 22.2 channel structure, which may operate at a bitrate of 128 kbps and 96 kbps. Referring to FIG. 22, 24 channel input signals may be input to six FCE encoders 2201 four by four. As described above with FIG. 18, the FCE encoder 2201 may generate a single channel output signal from four channel input signals. A single channel output signal output from each of the six FCE encoders 2201 may be output in a bitstream form through a bitstream formatter. That is, the bitstream may include six output signals.

The bitstream de-formatter may derive six output signals from the bitstream. The six output signals may be input to six FCE decoders 2202, respectively. As described above with FIG. 18, the FCE decoder 2202 may generate four channel output signals from a single channel output signal. A total of 24 channel output signals may be generated through six FCE decoders 2202.

Figure 23:
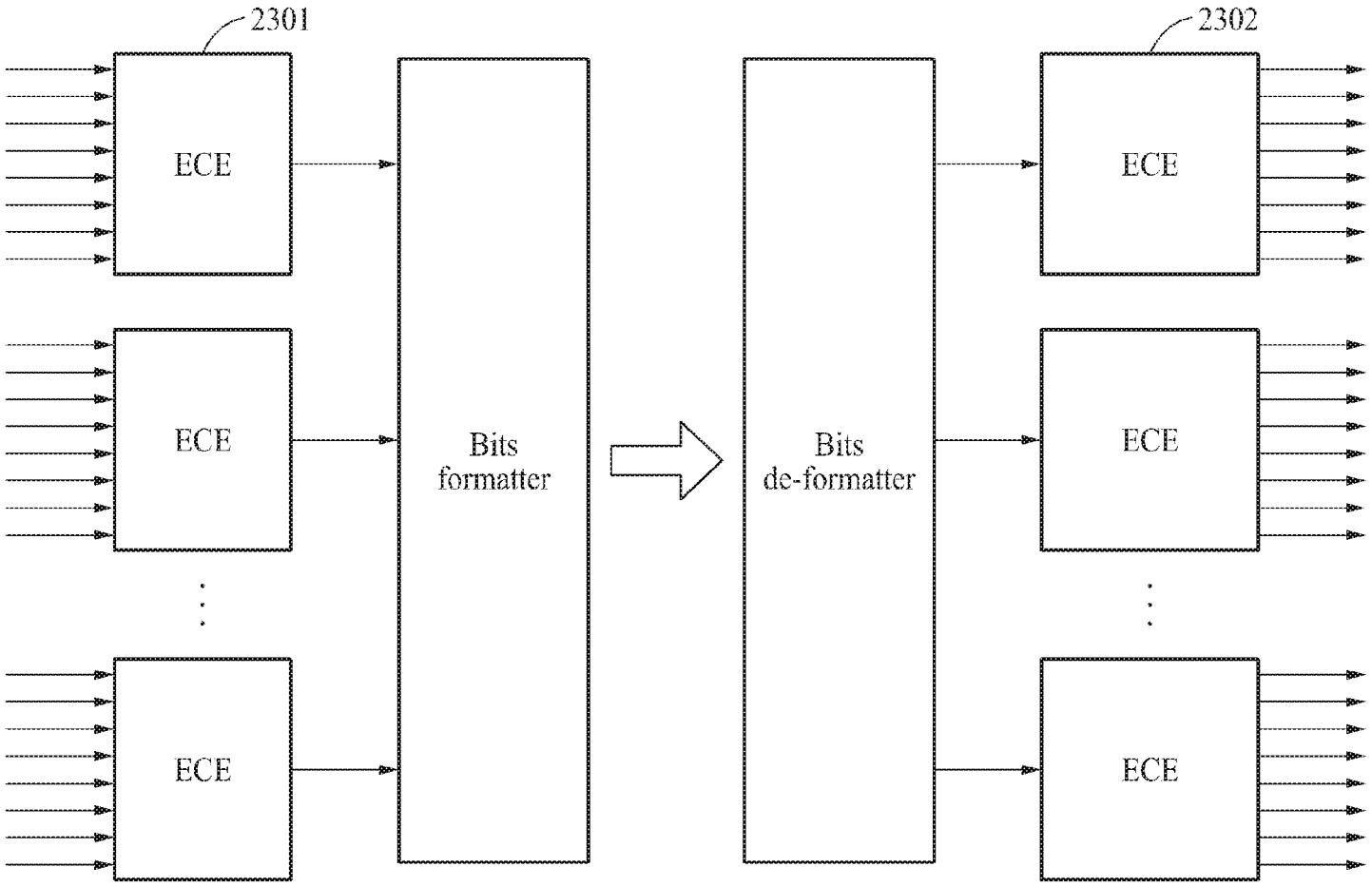
FIG. 23 is a diagram illustrating a process of processing 24 channel audio signals based on an ECE structure according to an embodiment.

FIG. 23 is a diagram illustrating a process of processing 24 channel audio signals based on an ECE structure according to an embodiment.

In FIG. 23, a case in which 24 channel input signals are input, which is the same as the 22.2 channel structure of FIG. 22 is assumed. However, an operation mode of FIG. 23 is assumed to be at a bitrate of 48 kbps and 64 kbps less than that of FIG. 22.

Referring to FIG. 23, 24 channel input signals may be input to three ECE encoders 2301 eight by eight. As described above with FIG. 20, the ECE encoder 2301 may generate a single channel output signal from eight channel input signals. A single channel output signal output from each of three ECE encoders 2301 may be output in a bitstream form through a bitstream formatter. That is, the bitstream may include three output signals.

A bitstream de-formatter may derive three output signals from the bitstream. Three output signals may be input to three ECE decoders 2302, respectively. As described above with reference to FIG. 20, the ECE decoder 2302 may generate eight channel output signals from a single channel input signal. Accordingly, a total of 24 channel output signals may be generated through three FCE decoders 2302.

Figure 24:
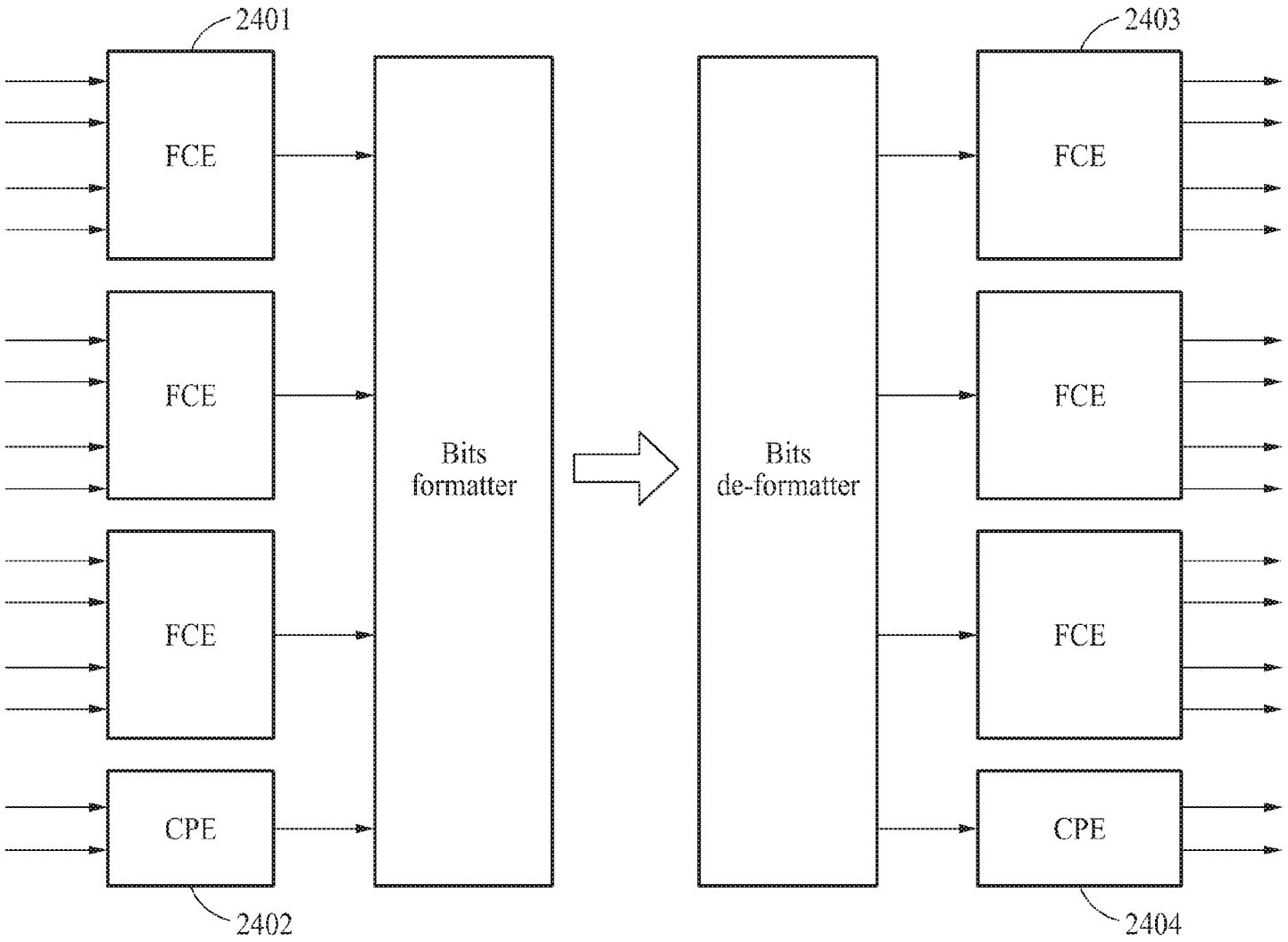
FIG. 24 is a diagram illustrating a process of processing 14 channel audio signals based on an FCE structure according to an embodiment.

FIG. 24 is a diagram illustrating a process of processing 14 channel audio signals based on an FCE structure according to an embodiment.

FIG. 24 illustrates a process of generating four channel output signals from 14 channel input signals using three FCE encoders 2401 and a single CPE encoder 2402. Here, an operation mode of FIG. 24 is at a relatively high bitrate such as 128 kbps and 96 kbps.

Each of three FCE encoders 2401 may generate a single channel output signal from four channel input signals. A single CPE encoder 2402 may generate a single channel output signal by downmixing two channel input signals. A bitstream de-formatter may generate a bitstream including four output signals from an output result of three FCE encoders 2401 and an output result of a single CPE encoder 2402.

Meanwhile, the bitstream de-formatter may extract four output signals from the bitstream, may transfer three output signals to three FCE decoders 2403, respectively, and may transfer a remaining single output signal to a single CPE decoder 2404. Each of three FCE decoders 2403 may generate four channel output signals from a single channel input signal. A single CPE decoder 2404 may generate two channel output signals from a single channel input signal. That is, a total of 14 output signals may be generated through three FCE decoders 2403 and a single CPE decoder 2404.

Figure 25:
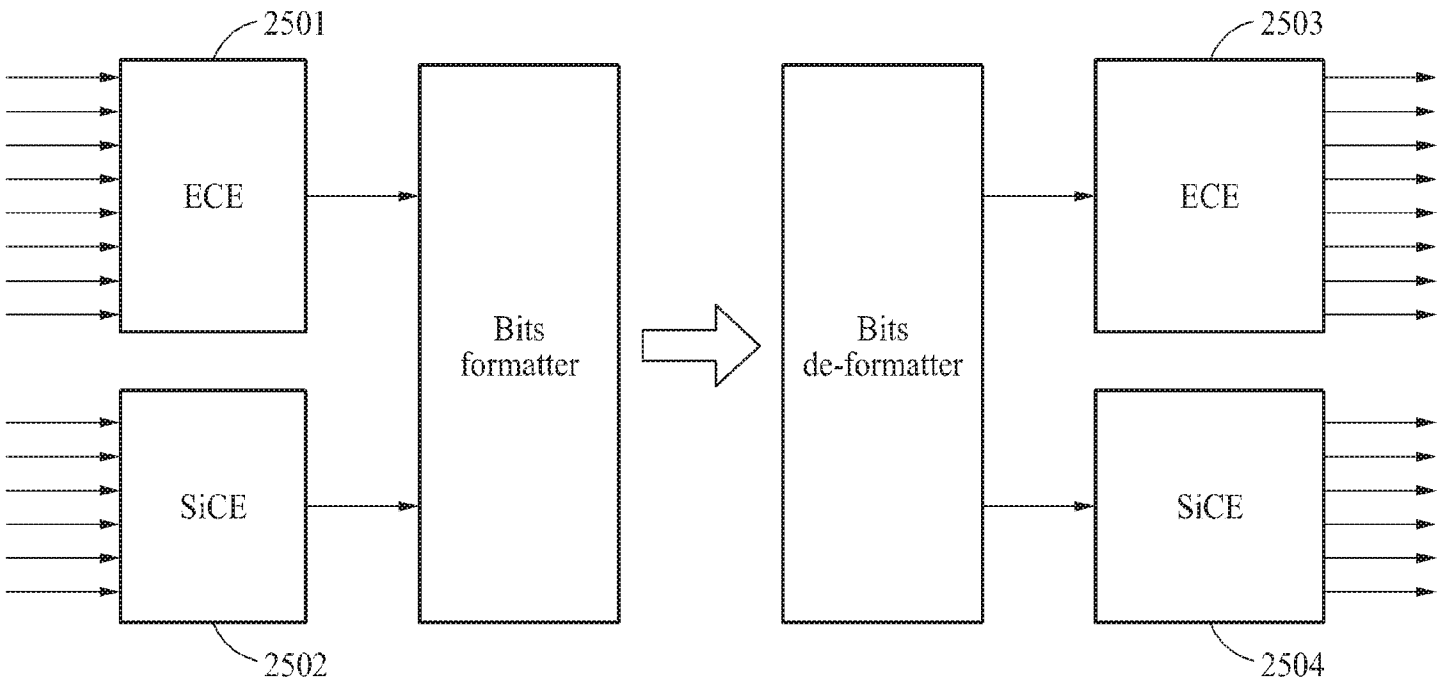
FIG. 25 is a diagram illustrating a process of processing 14 channel audio signals based on an ECE structure and an SiCE structure according to an embodiment.

FIG. 25 is a diagram illustrating a process of processing 14 channel audio signals based on an ECE structure and an SiCE structure according to an embodiment.

FIG. 25 illustrates a process of processing 14 channel input signals using an ECE encoder 2501 and an SiCE encoder 2502. Dissimilar to FIG. 24, FIG. 25 may be applicable to a relatively low bitrate, for example, 48 kbps and 96 kbps.

The ECE encoder 2501 may generate a single channel output signal from eight channel input signals among 14 channel input signals. The SiCE encoder 2502 may generate a single channel output signal from six channel input signals among 14 channel input signals. A bitstream formatter may generate a bitstream using an output result of the ECE encoder 2501 and an output result of the SiCE encoder 2502.

Meanwhile, a bitstream de-formatter may extract two output signals from the bitstream. The two output signals may be input to an ECE decoder 2503 and an SiCE decoder 2504, respectively. The ECE decoder 2503 may generate eight channel output signals from a single channel input signal and the SiCE decoder 2504 may generate six channel output signals from a single channel input signal. That is, a total of 14 output signals may be generated through the ECE decoder 2503 and the SiCE decoder 2504.

Figure 26:
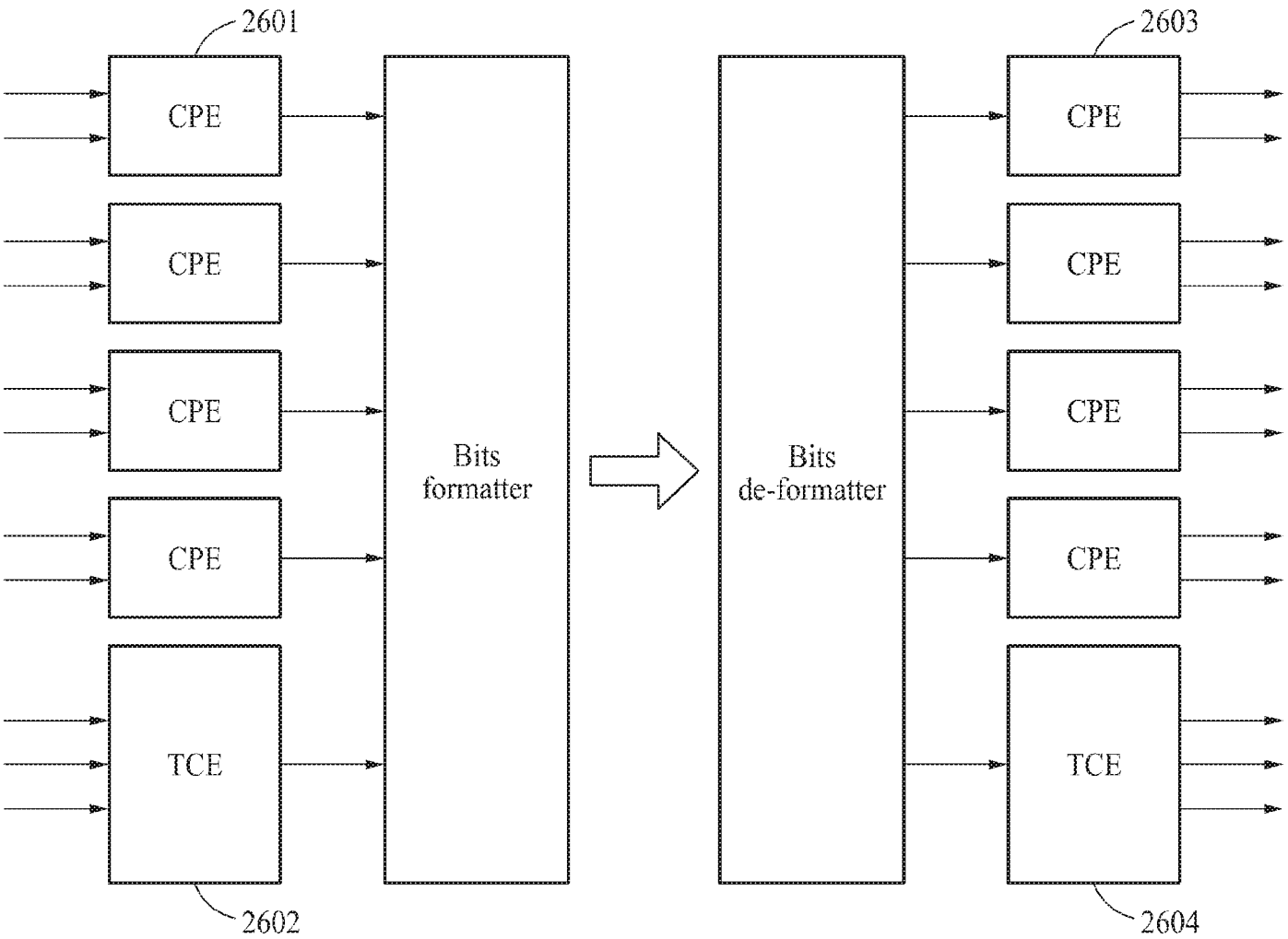
FIG. 26 is a diagram illustrating a process of processing 11.1 channel audio signals based on a TCE structure according to an embodiment.

FIG. 26 is a diagram illustrating a process of processing 11.1 channel audio signals based on a TCE structure according to an embodiment.

Referring to FIG. 26, four CPE encoders 2601 and a single TCE encoder 2602 may generate five channel output signals from 11.1 channel input signals. In FIG. 26, audio signals may be processed at a relatively high bitrate, for example, 128 kbps and 96 kbps. Each of four CPE encoders 2601 may generate a single channel output signal from two channel input signals. Meanwhile, a single TCE encoder 2602 may generate a single channel output signal from three channel input signals. An output result of four CPE encoders 2601 and an output result of a single TCE encoder 2602 may be input to a bitstream formatter and be output as a bitstream. That is, the bitstream may include five channel output signals.

Meanwhile, a bitstream de-formatter may extract five channel output signals from the bitstream. Five output signals may be input to four CPE decoders 2603 and a single TCE decoder 2604, respectively. Each of four CPE decoders 2603 may generate two channel output signals from a single channel input signal. The TCE decoder 2604 may generate three channel output signals from a single channel input signal. Accordingly, four CPE decoders 2603 and a single TCE decoder 2604 may output 11 channel output signals.

Figure 27:
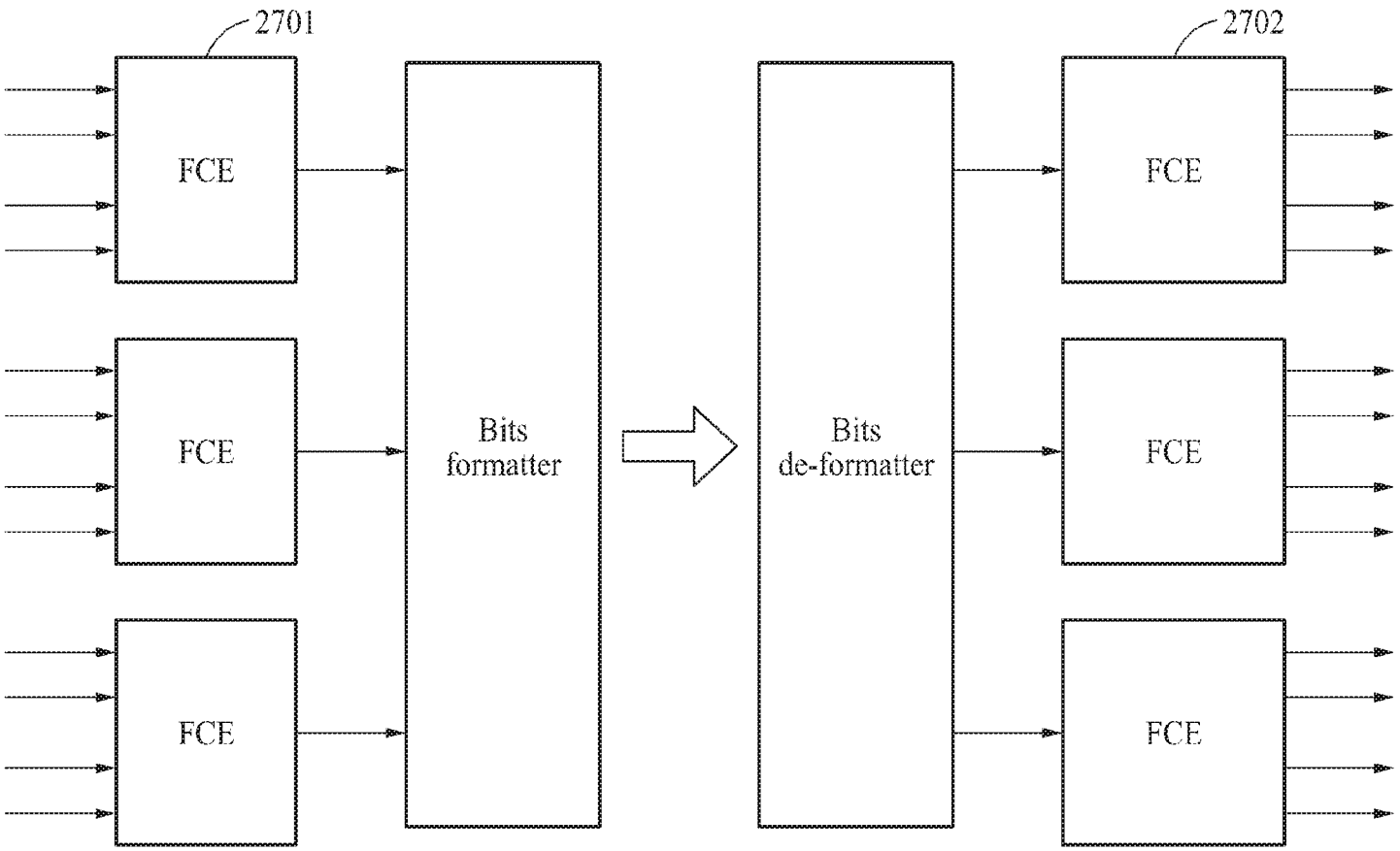
FIG. 27 is a diagram illustrating a process of processing 11.1 channel audio signals based on an FCE structure according to an embodiment.

FIG. 27 is a diagram illustrating a process of processing 11.1 channel audio signals based on an FCE structure according to an embodiment.

Dissimilar to FIG. 26, in FIG. 27, audio signals may be processed at a relatively low bitrate, for example, 64 kbps and 48 kbps. Referring to FIG. 27, three channel output signals may be generated from 12 channel input signals through three FCE encoders 2701. In detail, each of three FCE encoders 2701 may generate a single channel output signal from four channel input signals among 12 channel input signals. A bitstream formatter may generate a bitstream using three channel output signals that are output from three FCE encoders 2701, respectively.

Meanwhile, a bitstream de-formatter may output three channel output signals from the bitstream. Three channel output signals may be input to three FCE decoders 2702, respectively. The FCE decoder 2702 may generate three channel output signals from a single channel input signal. Accordingly, a total of 12 channel output signals may be generated through three FCE decoders 2702.

Figure 28:
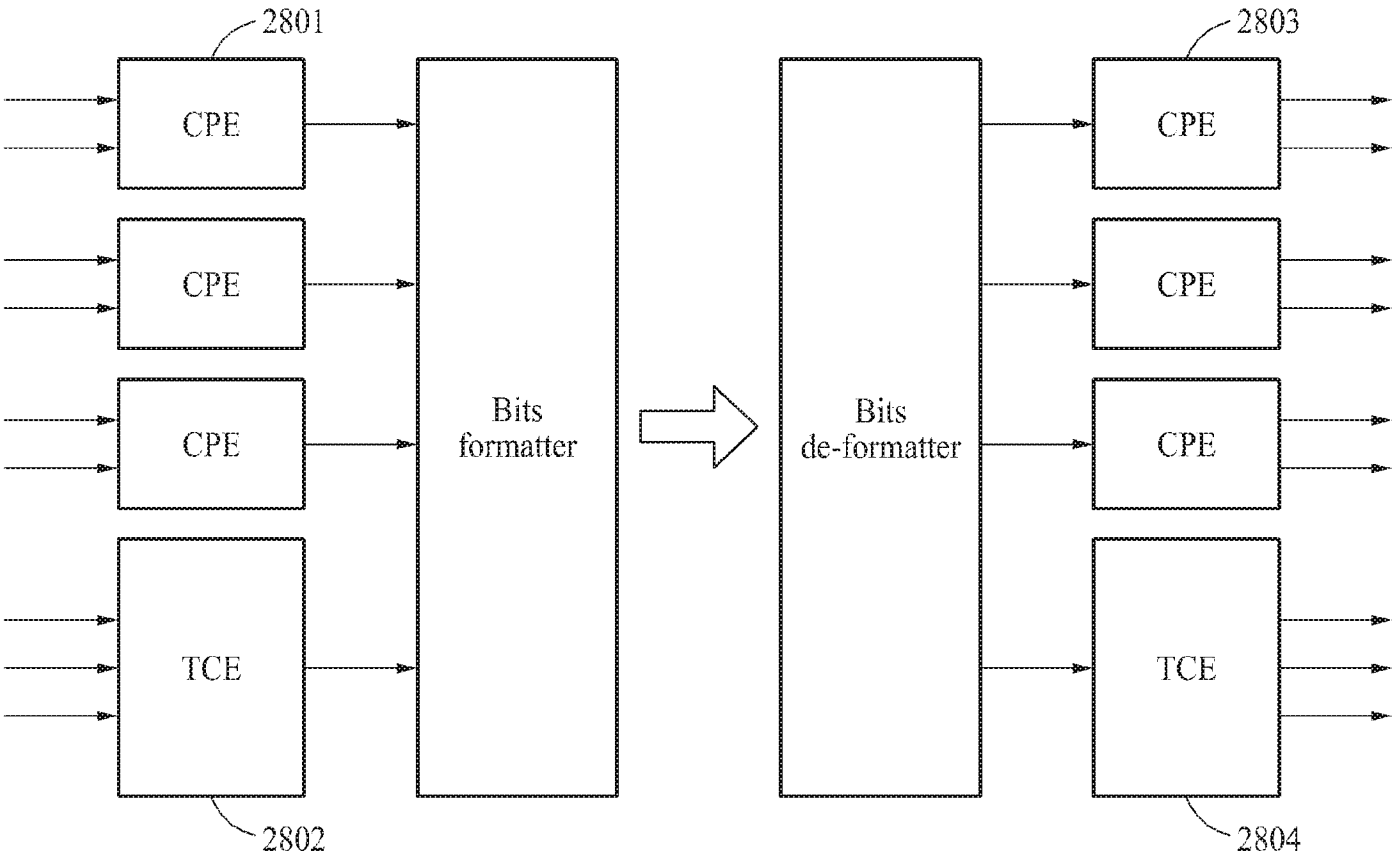
FIG. 28 is a diagram illustrating a process of processing 9.0 channel audio signals based on a TCE structure according to an embodiment.

FIG. 28 is a diagram illustrating a process of processing 9.0 channel audio signals based on a TCE structure according to an embodiment.

Figure 29:
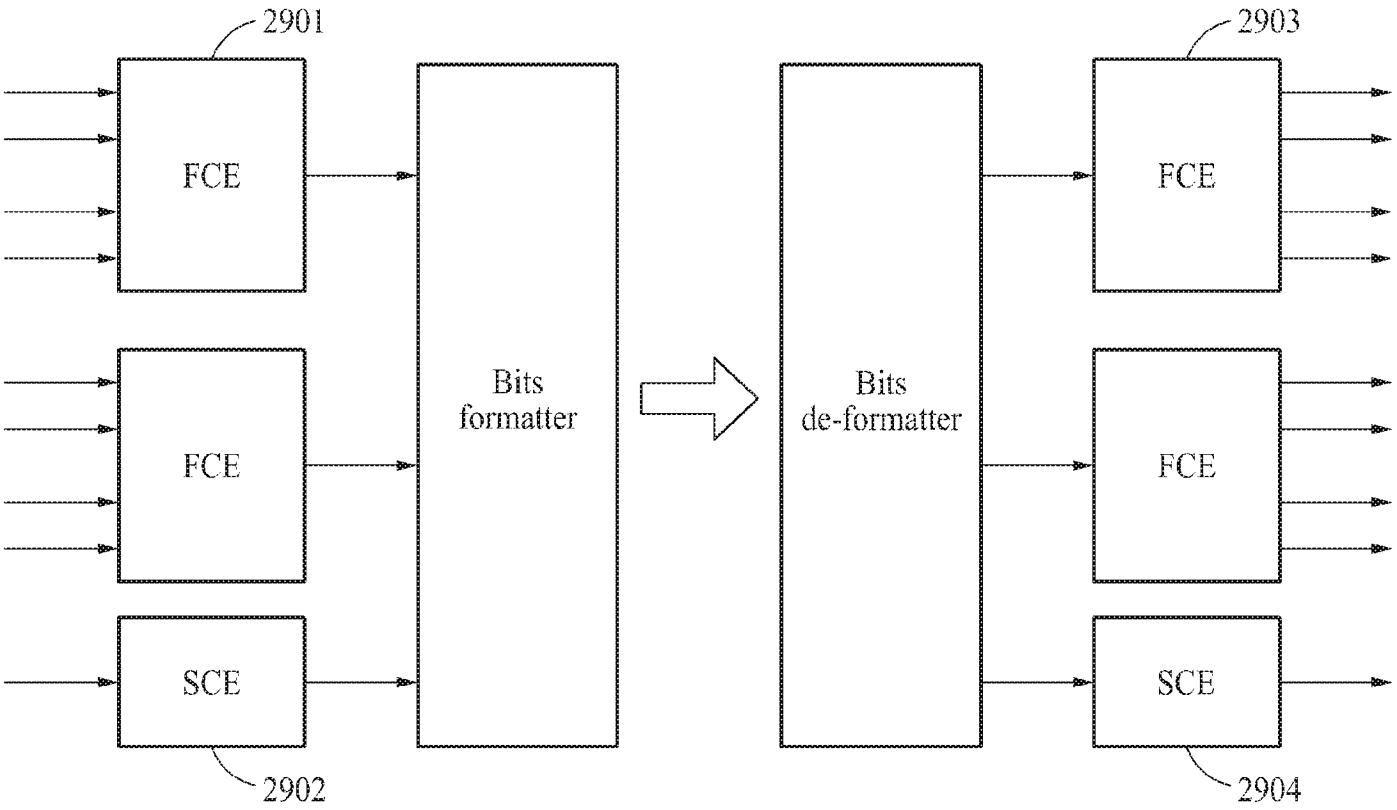
FIG. 29 is a diagram illustrating a process of processing 9.0 channel audio signals based on an FCE structure according to an embodiment.

FIG. 28 illustrates a process of processing nine channel input signals. In FIG. 29, nine channel input signals may be processed at a relatively high bitrate, for example, 128 kbps and 96 kbps. Here, nine channel input signals may be processed based on three CPE encoders 2801 and a single TCE encoder 2802. Each of three CPE encoders 2801 may generate a single channel output signal from two channel input signals. Meanwhile, a single TCE encoder 2802 may generate a single channel output signal from three channel input signals. Accordingly, a total of four channel output signals may be input to a bitstream formatter and be output as a bitstream.

A bitstream de-formatter may extract four channel output signals included in the bitstream. Four channel output signals may be input to three CPE decoders 2803 and a single TCE decoder 2804, respectively. Each of three CPE decoders 2803 may generate two channel output signals from a single channel input signal. A single TCE decoder 2804 may generate three channel output signals from a single channel input signal. Accordingly, a total of nine channel output signals may be generated.

FIG. 29 is a diagram illustrating a process of processing 9.0 channel audio signals based on an FCE structure according to an embodiment.

FIG. 29 illustrates a process of processing 9 channel input signals. In FIG. 29, 9 channel input signals may be processed at a relatively low bitrate, for example, 64 kbps and 48 kbps. Here, 9 channel input signals may be processed through two FCE encoders 2901 and a single SCE encoder 2902. Each of two FCE encoders 2901 may generate a single channel output signal from four channel input signals. A single SCE encoder 2902 may generate a single channel output signal from a single channel input signal. Accordingly, a total of three channel output signals may be input to a bitstream formatter and be output as a bitstream.

A bitstream de-formatter may extract three channel output signals included in the bitstream. Three channel output signals may be input to two FCE decoders 2903 and a single SCE decoder 2904, respectively. Each of two FCE decoders 2903 may generate four channel output signals from a single channel input signal. A single SCE decoder 2904 may generate a single channel output signal from a single channel input signal. Accordingly, a total of nine channel output signals may be generated.

Table 11 shows a configuration of a parameter set based on the number of input signal channels when performing spatial coding. Here, bsFreqRes denotes the same number of analysis bands as the number of USAC encoders.

TABLE 11

| | | Parameter configuration | | |
|---|---|---|---|---|
| Layout | Bitrate | Parameter set | bsFreqRes | # of bands |
| 24 channel | 128 kbps | CLD, ICC, IPD | 2 | 20 |
| | 96 kbps | CLD, ICC, IPD | 4 | 10 |
| | 64 kbps | CLD, ICC | 4 | 10 |
| | 48 kbps | CLD, ICC | 5 | 7 |
| 14, 12 channel | 128 kbps | CLD, ICC, IPD | 2 | 20 |
| | 96 kbps | CLD, ICC, IPD | 2 | 20 |
| | 64 kbps | CLD, ICC | 4 | 10 |
| | 48 kbps | CLD, ICC | 4 | 10 |
| 9 channel | 128 kbps | CLD, ICC, IPD | 1 | 28 |
| | 96 kbps | CLD, ICC, IPD | 2 | 20 |
| | 64 kbps | CLD, ICC | 4 | 10 |
| | 48 kbps | CLD, ICC | 4 | 10 |

The USAC encoder may encode a core band of an input signal. The USAC encoder may control a plurality of encoders based on the number of input signals, using mapping information between a channel based on metadata and an object. Here, the metadata indicates relationship information among channel elements (CPEs and SCEs), objects, and rendered channel signals. Table 12 shows a bitrate and a sampling rate used for the USAC encoder. An encoding parameter of spectral band replication (SBR) may be appropriately adjusted based on a sampling rate of Table 12.

TABLE 12

| Bitrate | Sampling Rate (kHz) 24 ch | 14 ch | 12 ch | 9 ch |
|---|---|---|---|---|
| 128 kbps | 32 | 44.1 | 44.1 | 44.1 |
| 96 kbps | 28.8 | 35.2 | 44.1 | 44.1 |
| 64 kbps | 28.8 | 35.2 | 32.0 | 32.0 |
| 48 kbps | 28.8 | 32 | 28.8 | 32.0 |

The methods according to the embodiments may be recorded in non-transitory computer-readable media including program instructions to implement various operations embodied by a computer. The media may also include, alone or in combination with the program instructions, data files, data structures, and the like. Examples of the program instructions may be specially designed and configured for the present disclosure and be known to the computer software art.

Although a few embodiments have been shown and described, the present disclosure is not limited to the described embodiments. Instead, it will be appreciated by those skilled in the art that various changes and modifications can be made to these embodiments without departing from the principles and spirit of the disclosure.

Accordingly, the scope of the disclosure is not limited to or limited by the embodiments and instead, is defined by the claims and their equivalents.

What is claimed is:

1. A method of processing a multi-channel audio signal, the method comprising:

identifying a residual signal and N/2 channel downmix signals;

applying the residual signal and N/2 channel downmix signals into a pre-decorrelator matrix of a N-N/2-N structure defined based on bsTreeConfig;

applying an output result of the pre-decorrelator matrix into mix matrix of the N-N/2-N structure;

outputting a N channel output signal as an output result of the mix matrix, wherein the number of OTT box of the N-N/2-N structure is same as the number of a channel for the N/2 channel downmix signals.

2. The method of claim 1, wherein the N/2 decorrelators correspond to the N/2 OTT boxes, when a Low Frequency Enhancement (LFE) channel is not included in the N channel output signals.

3. The method of claim 1, wherein indices of the decorrelators are repeatedly reused based on the reference value, when the number of decorrelators exceeds a reference value of a modulo operation.

4. The method of claim 1, wherein, when an LFE channel is included in the N channel output signals, the decorrelators corresponding to the remaining number excluding the number of LFE channels from N/2 are used, and the LTE channel does not use an OTT box decorrelator.

5. The method of claim 1, wherein, when a temporal shaping tool is not used, a single vector including the second signal, the decorrelated signal derived from the decorrelator, and the residual signal derived from the decorrelator is input to the second matrix.

6. The method of claim 1, wherein, when a temporal shaping tool is used, a vector corresponding to a direct signal including the second signal and the residual signal derived from the decorrelator and a vector corresponding to a diffuse signal including the decorrelated signal derived from the decorrelator are input to the second matrix.

7. The method of claim 6, wherein the generating of the N channel output signals comprises shaping a temporal envelope of an output signal by applying a scale factor based on the diffuse signal and the direct signal to a diffuse signal portion of the output signal, when a Subband Domain Time Processing (STP) is used.

8. The method of claim 6, wherein the generating of the N channel output signals comprises flattening and reshaping an envelope corresponding to a direct signal portion for each channel of N channel output signals when a Guided Envelope Shaping (GES) is used.

9. The method of claim 1, wherein a size of the first matrix is determined based on the number of downmix signal channels and the number of decorrelators to which the first matrix is to be applied, and an element of the first matrix is determined based on a Channel Level Difference (CLD) parameter or a Channel Prediction Coefficient (CPC) parameter.

10. An apparatus for processing a multi-channel audio signal, the apparatus comprising:

one or more processor configured to:

identify a residual signal and N/2 channel downmix signals generated from N channel input signals;

generate a first signal by applying the residual signal and N/2 channel downmix signals into a pre-decorrelator matrix;

generate a second signal by applying the residual signal and N/2 channel downmix signals into the pre-decorrelator matrix, output a N channel output signal by applying the first signal and second signal into mix matrix, wherein the first signal is decorrelated based on N/2 decorrelators, and the second signal is not decorrelated based on the N/2 decorrelators.

11. The apparatus of claim 10, wherein the N/2 decorrelators correspond to the N/2 OTT boxes, when a Low Frequency Enhancement (LFE) channel is not included in the N channel output signals.

12. The apparatus of claim 10, wherein indices of the decorrelators are repeatedly reused based on the reference value, when the number of decorrelators exceeds a reference value of a modulo operation.

13. The apparatus of claim 10, wherein, when an LFE channel is included in the N channel output signals, the decorrelators corresponding to the remaining number excluding the number of LFE channels from N/2 are used, and the LTE channel does not use an OTT box decorrelator.

14. The apparatus of claim 10, wherein, when a temporal shaping tool is not used, a single vector including the second signal, the decorrelated signal derived from the decorrelator, and the residual signal derived from the decorrelator is input to the second matrix.

15. The apparatus of claim 10, wherein, when a temporal shaping tool is used, a vector corresponding to a direct signal including the second signal and the residual signal derived from the decorrelator and a vector corresponding to a diffuse signal including the decorrelated signal derived from the decorrelator are input to the second matrix.

16. The apparatus of claim 15, wherein the processor is configured to perform shaping a temporal envelope of an output signal by applying a scale factor based on the diffuse signal and the direct signal to a diffuse signal portion of the output signal, when a Subband Domain Time Processing (STP) is used.

17. The apparatus of claim 15, wherein the processor is configured to perform flattening and reshaping an envelope corresponding to a direct signal portion for each channel of N channel output signals when a Guided Envelope Shaping (GES) is used.

18. The apparatus of claim 10, wherein a size of the first matrix is determined based on the number of downmix signal channels and the number of decorrelators to which the first matrix is to be applied, and an element of the first matrix is determined based on a Channel Level Difference (CLD) parameter or a Channel Prediction Coefficient (CPC) parameter.

* * * * *